US011680369B2

(12) United States Patent
Collins et al.

(10) Patent No.: US 11,680,369 B2
(45) Date of Patent: Jun. 20, 2023

(54) WOVEN PAPERMAKING FABRIC INCLUDING STABILIZED WEAVE PROVIDING TEXTURED CONTACTING SURFACE

(71) Applicant: Kimberly-Clark Worldwide, Inc., Neenah, WI (US)

(72) Inventors: Lynda Ellen Collins, Neenah, WI (US); Mark Alan Burazin, Oshkosh, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 17/829,755

(22) Filed: Jun. 1, 2022

(65) Prior Publication Data

US 2022/0290371 A1 Sep. 15, 2022

Related U.S. Application Data

(62) Division of application No. 16/650,058, filed as application No. PCT/US2018/053079 on Sep. 27, 2018, now Pat. No. 11,377,793.

(Continued)

(51) Int. Cl.

| | |
|---|---|
| ***D21F 1/00*** | (2006.01) |
| ***D21F 5/18*** | (2006.01) |
| ***D21F 11/00*** | (2006.01) |

(52) U.S. Cl.

CPC ..... *D21F 1/0036* (2013.01); *D21F 5/18* (2013.01); *D21F 11/006* (2013.01)

(58) Field of Classification Search

CPC ..... D21F 1/0036; D21F 5/18; D21F 11/006; D21F 11/14; D21F 7/08; D21F 1/00; D03D 13/00

See application file for complete search history.

(56) References Cited

U.S. PATENT DOCUMENTS 5,228,482 A 7/1993 Fleischer
5,240,763 A 8/1993 Wagner et al.

(Continued)

FOREIGN PATENT DOCUMENTS

CN 2885922 Y 4/2007
CN 204000435 U 12/2014

(Continued)

*Primary Examiner* — Eric Hug
*Assistant Examiner* — Matthew M Eslami
(74) *Attorney, Agent, or Firm* — Kimberly-Clark Worldwide, Inc.

(57) ABSTRACT

The present invention relates to papermaking fabrics useful in the manufacture of paper products, such as tissue paper. Particularly this invention relates to a woven papermaking fabric that includes a stabilized weave providing a textured contacting surface. The woven papermaking fabric includes a plurality of warp and shute filaments woven together to provide at least one protuberance on the web contacting side of the fabric that extends longitudinally over at least five shute filaments. The at least one protuberance is stabilized by including an offset shute float weave pattern configured such that a majority of the shute filaments forming the at least one protuberance are woven in an anti-nesting configuration.

11 Claims, 25 Drawing Sheets

Related U.S. Application Data

(60) Provisional application No. 62/565,640, filed on Sep. 29, 2017.

(56) References Cited

U.S. PATENT DOCUMENTS

| | | | |
|---|---|---|---|
| 5,456,293 | A | 10/1995 | Ostermayer et al. |
| 5,520,225 | A | 5/1996 | Quigley et al. |
| 5,713,397 | A | 2/1998 | Quigley |
| 5,832,962 | A | 11/1998 | Kaufman et al. |
| 6,017,417 | A | 1/2000 | Wendt et al. |
| 6,402,895 | B1 | 6/2002 | Best |
| 6,660,362 | B1 | 12/2003 | Linsay et al. |
| 6,673,202 | B2 | 1/2004 | Burazin et al. |
| 7,166,189 | B2 | 1/2007 | Burazin et al. |
| 7,235,156 | B2 | 6/2007 | Baggot |
| 7,294,229 | B2 | 11/2007 | Hada et al. |
| 7,300,543 | B2 | 11/2007 | Mullally et al. |
| 7,611,605 | B2 | 11/2009 | Burazin et al. |
| 7,611,607 | B2 | 11/2009 | Mullally et al. |
| 7,726,349 | B2 | 6/2010 | Mullally et al. |
| 7,935,409 | B2 | 5/2011 | Burazin et al. |
| 2001/0032712 | A1 | 10/2001 | Friedbauer et al. |
| 2002/0056536 | A1 | 5/2002 | Lamb |
| 2003/0079850 | A1 | 5/2003 | Rougvie |
| 2003/0084952 | A1* | 5/2003 | Burazin ..... D21F 1/0036 162/902 |
| 2007/0209770 | A1 | 9/2007 | Barrett et al. |
| 2008/0110591 | A1 | 5/2008 | Mullally et al. |
| 2008/0169040 | A1 | 7/2008 | Barrett |
| 2009/0211722 | A1 | 8/2009 | Crook et al. |
| 2014/0231039 | A1 | 8/2014 | Patel et al. |
| 2016/0215451 | A1* | 7/2016 | Uymur ..... D21F 1/0036 |
| 2017/0211235 | A1 | 7/2017 | Lamb |

FOREIGN PATENT DOCUMENTS

| | | | |
|---|---|---|---|
| CN | 206438338 | U | 8/2017 |
| WO | 2000012817 | A1 | 3/2000 |
| WO | 2013023276 | A1 | 2/2013 |
| WO | 2019067685 | A1 | 4/2019 |
| WO | 2019067686 | A1 | 4/2019 |
| WO | 2019067690 | A1 | 4/2019 |
| WO | 2020068091 | A1 | 4/2020 |
| WO | 2020068092 | A1 | 4/2020 |

* cited by examiner

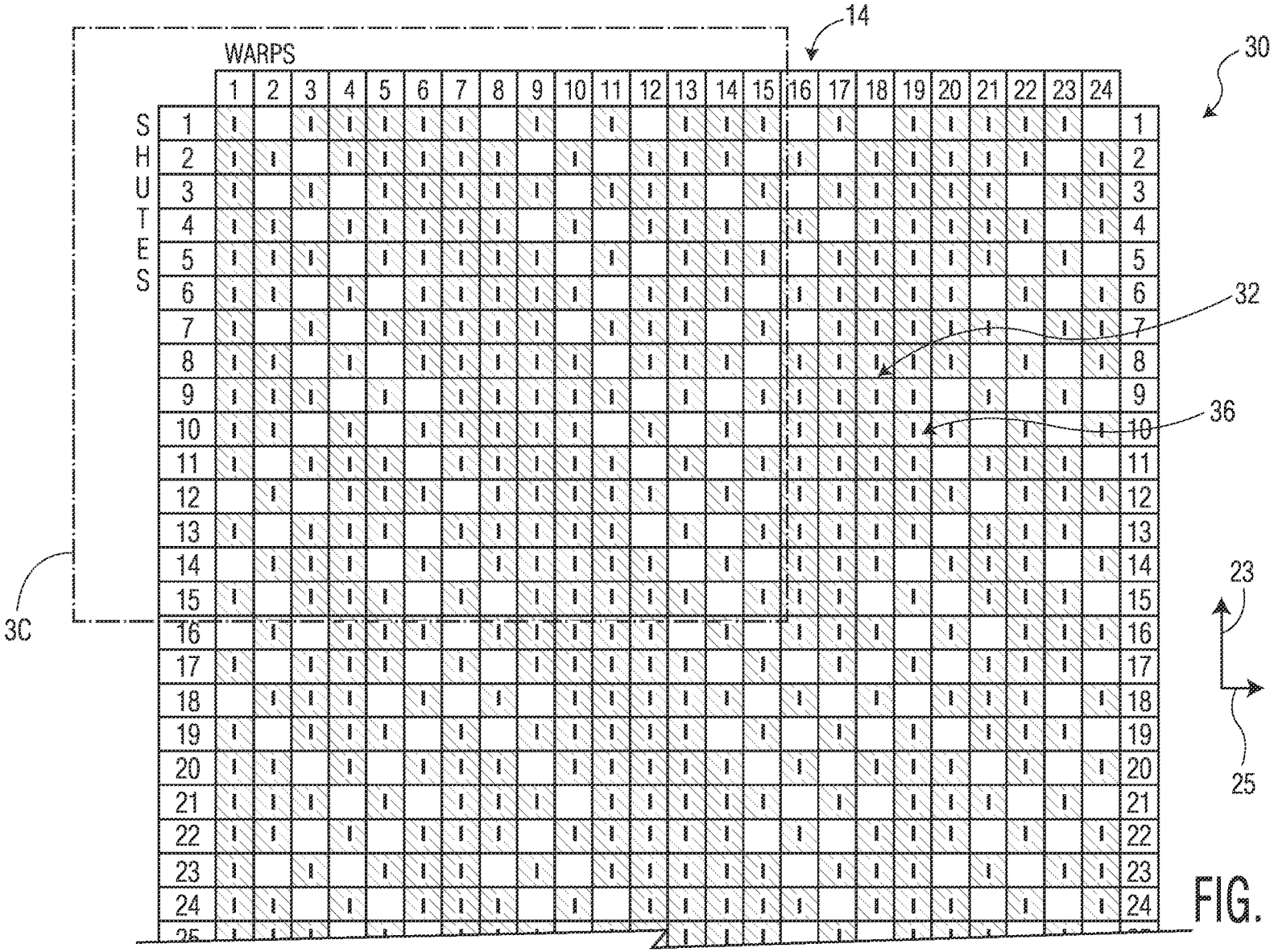
FIG. 3A1

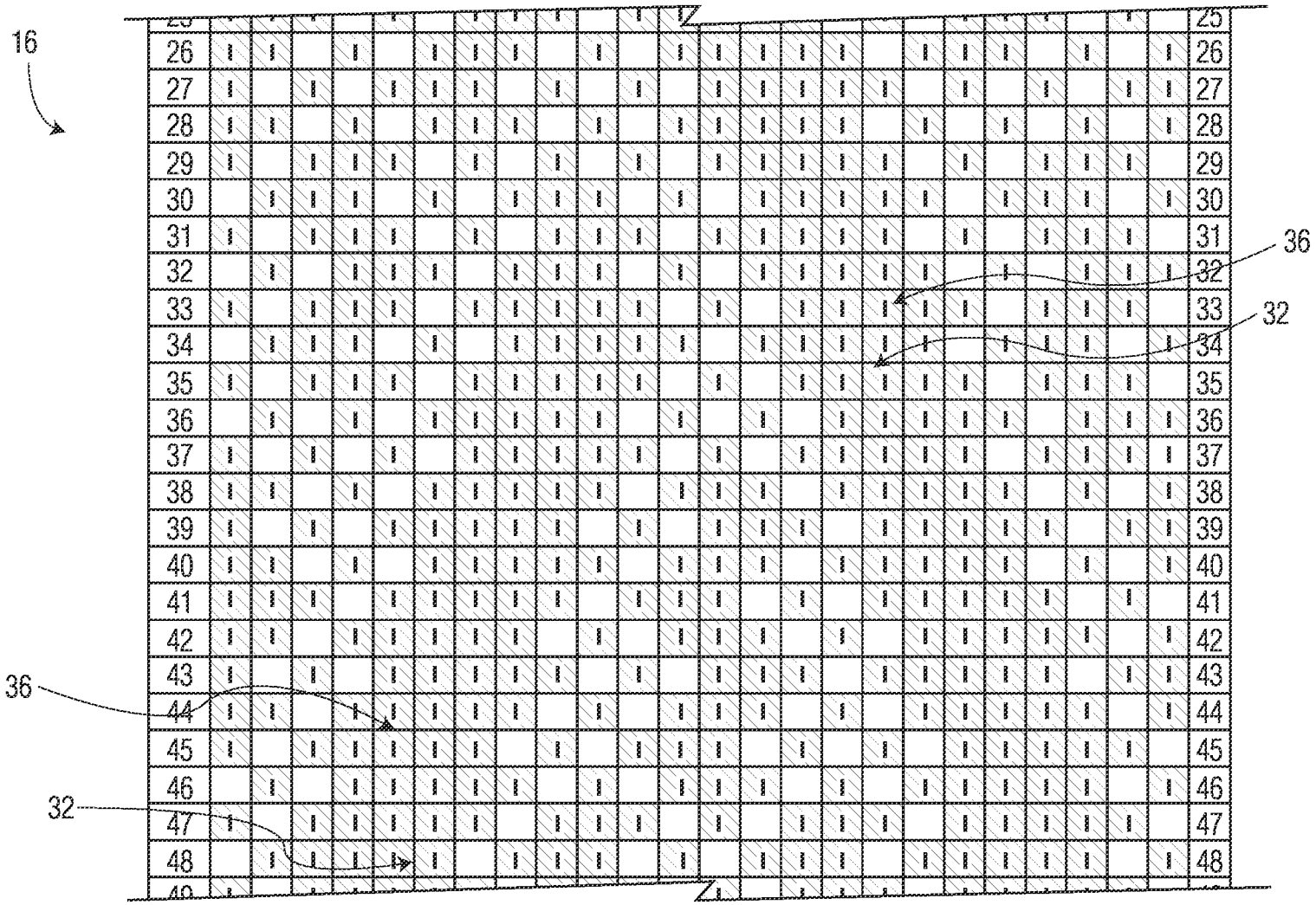
FIG. 3A2

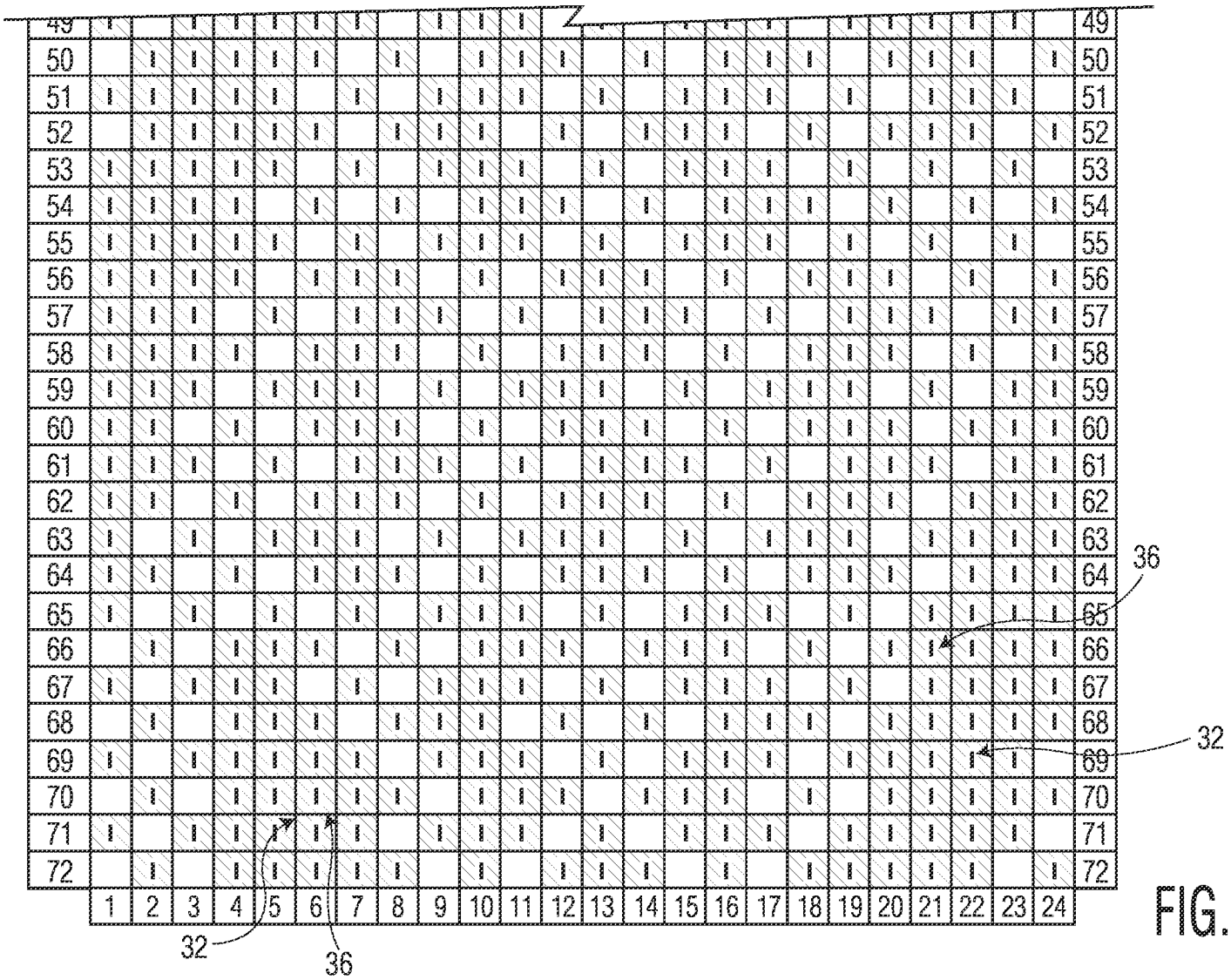
FIG. 3A3

WOVEN PAPERMAKING FABRIC INCLUDING STABILIZED WEAVE PROVIDING TEXTURED CONTACTING SURFACE

RELATED APPLICATIONS

The present application is a divisional application and claims priority to U.S. patent application Ser. No. 16/650,058, filed on Mar. 24, 2020, which is a national-phase entry, under 35 U.S.C. § 371, of PCT Patent Application No. PCT/US18/53079, filed on Sep. 27, 2018, which claims benefit of U.S. Provisional Application No. 62/565,640, filed on Sep. 29, 2017, all of which are incorporated herein by reference.

BACKGROUND

The present invention relates to the field of paper manufacturing. More particularly, the present invention relates to the manufacture of absorbent tissue products such as bath tissue, facial tissue, napkins, towels, wipers, cardboard, and the like. Specifically, the present invention relates to improved papermaking fabrics used to manufacture absorbent tissue products having background regions optionally bordered by decorative elements, methods of tissue manufacture, methods of fabric manufacture, and the actual tissue products produced thereby.

In the manufacture of tissue products, particularly absorbent tissue products, papermaking fibers are deposited onto forming wires and transferred as a newly-formed web to a transfer fabric, often with the aid of a vacuum box. From the transfer fabric, the web is then transferred to a through-air drying fabric to dry the web, which can provide the physical properties and the final product appearance to the web. There is a continuing need to improve through-air drying fabrics for improved operation of the machine as well as improved properties of the web and its visual appearance. In addition, there is a continuing need to improve the physical properties and final product appearance.

Various weave patterns in papermaking fabrics have been used to produce textures by having a combination of tightly woven areas and loosely woven areas that are juxtaposed to create unbalanced forces that cause the loosely woven areas to push out of plane to create one or more protuberance on the fabric. The areas that are pushed out of plane on the fabric create surface topography for the fabric. However, predicting which structures will produce desirable fabric attributes has proven to be difficult. Weave patterns for fabric must consider the resultant pocket depth created by the protuberances, the width of such pockets between protuberances, the pore size and pore distribution created by the interstitial spacing of the filaments forming weave pattern. Additional factors affecting the papermaking fabric development cycle including warp and shute filament size, weave tension, pick count, heat set, among others, and each can affect the resulting papermaking fabric topography.

In addition to creating the required fabric technical attributes, creating desirable aesthetics that can be transferred to the product also provides challenges. Some weave patterns that include arcs and turns create irregular forces during weaving, and thus, lack stability. Other more stable weave patterns are limited in their aesthetic capabilities provided to the topography of the papermaking fabric, and thus limit the variety of aesthetics that can be transferred to the product.

As such, there remains a need for articles of manufacture and methods of producing tissue products having visually discernable patterns with improved physical properties without losses to tissue machine efficiency and productivity.

SUMMARY

The present invention comprises paper manufacturing articles and processes that may satisfy one or more of the foregoing needs. For example, a woven papermaking fabric of the present invention, when used as a through-air drying fabric in a tissue making process, produces an absorbent tissue product having a substantially uniform density as well as optionally possessing visually discernible decorative elements. The papermaking fabrics of the present disclosure could alternatively be used as transfer fabrics. The present disclosure is also directed towards fabrics for manufacturing the absorbent tissue product, processes of making the absorbent tissue product, and processes of making the papermaking fabric.

Accordingly, in one aspect a woven papermaking fabric is provided. The woven papermaking fabric can include a plurality of filaments woven together. The plurality of filaments can include a plurality of warp filaments extending in a longitudinal direction and a plurality of shute filaments extending in a lateral direction. The shute filaments can be interwoven with warp filaments to provide a web contacting side of the woven papermaking fabric and a machine contacting side of the woven papermaking fabric. The woven papermaking fabric can also include at least one protuberance on the web contacting side of the woven papermaking fabric. The at least one protuberance can extend longitudinally over at least five shute filaments. Each shute filament forming part of the at least one protuberance can include a float proximal end and a float distal end. The at least one protuberance can be stabilized by including an offset shute float weave pattern configured such that a majority of the shute filaments forming the at least one protuberance are woven in an anti-nesting configuration.

In another aspect, a method of manufacturing a woven papermaking fabric is provided. The method can include providing a first set of filaments to serve as warp filaments in a loom. The warp filaments can extend in a longitudinal direction. The method can also include providing a second set of filaments to serve as shute filaments. The method can additionally include weaving the shute filaments with the warp filaments in a lateral direction to provide a web contacting side of the woven papermaking fabric and a machine contacting side of the woven papermaking fabric and to provide at least one protuberance on the web contacting side of the woven papermaking fabric. The at least one protuberance can extend longitudinally over at least five shute filaments. Each of the shute filaments forming the at least one protuberance can include a float proximal end and a float distal end. The method can further include stabilizing the at least one protuberance on the web contacting side of the fabric by weaving the shute filaments forming the at least one protuberance in an offset shute float weave pattern. The offset shute float weave can be configured such that a majority of the shute filaments forming the at least one protuberance are woven in an anti-nesting configuration.

In yet another aspect, another method of manufacturing a woven papermaking fabric is provided. The method can include providing a first set of filaments to serve as warp filaments in a loom. The warp filaments can extend in a longitudinal direction. The method can include providing a second set of filaments to serve as shute filaments in the loom. The method can also include providing a plurality of weave patterns corresponding to design elements for the woven fabric. The plurality of weave patterns can include a first weave pattern corresponding to a first design element and a second weave pattern corresponding to a second design element. The first design element can be different from the second design element. The method can additionally include selecting the first weave pattern corresponding to the first design element and selecting the second weave pattern corresponding to the second design element. The method can further include weaving the shute filaments with the warp filaments in a lateral direction to provide a web contacting side of the woven papermaking fabric and a machine contacting side of the woven papermaking fabric and following the first weave pattern to provide a first protuberance on the web contacting side of the woven papermaking fabric providing the first design element and following the second weave pattern to provide a second protuberance on the web contacting side of the woven papermaking fabric providing the second design element. Each of the shute filaments forming the first protuberance and each of the shute filaments forming the second protuberance each comprise a float proximal end and a float distal end. The first protuberance and the second protuberance can be stabilized by weaving the shute filaments forming the first protuberance and weaving the shute filaments forming the second protuberance to each have an offset shute float weave pattern. The offset shute float weave pattern can be configured such that a majority of the shute filaments forming the first protuberance and a majority of the shute filaments forming the second protuberance being woven in an anti-nesting configuration.

DESCRIPTION OF THE DRAWINGS

FIG. 3A1-3A3 illustrate a unit cell of a first exemplary weave pattern to produce a papermaking fabric of the present disclosure.

DEFINITIONS

As used herein, the term "tissue product" refers to products made from tissue webs and includes, bath tissues, facial tissues, paper towels, industrial wipers, foodservice wipers, napkins, medical pads, medical gowns, and other similar products. Tissue products may comprise one, two, three or more plies.

As used herein, the terms "tissue web" and "tissue sheet" refer to a fibrous sheet material suitable for forming a tissue product.

As used herein, the term "continuous protuberance" refers to a three-dimensional element on a papermaking belt that extends without interruption throughout one dimension of the belt.

As used herein, the term "discrete protuberance" refers to separate, unconnected three-dimensional elements disposed on a papermaking belt that do not extend continuously in any dimension of the belt.

As used herein, the term "curvilinear decorative element" refers to any line or visible pattern that contains either straight sections, curved sections, or both that are substantially connected visually. Curvilinear decorative elements may appear as undulating lines, substantially connected visually, forming signatures or patterns. Curvilinear decorative elements include calligraphic lines.

Also, as used herein "decorative pattern" refers to any non-random repeating design, figure, or motif. It is not necessary that the curvilinear decorative elements form recognizable shapes, and a repeating design of the curvilinear decorative elements is considered to constitute a decorative pattern.

DETAILED DESCRIPTION

The present inventors have now surprisingly discovered that certain woven papermaking belts and in particular through-air drying fabrics having patterns disposed thereon may be used to produce tissue webs and products that are both smooth and have high bulk without compromising operating efficiency utilizing new manufacturing methods to produce such papermaking belts. Accordingly, in certain embodiments the present invention provides an apparatus for manufacturing paper and more preferably tissue webs and products. The apparatus according to the present invention is preferably embodied in a papermaking fabric. In preferred embodiments, the papermaking fabric can be utilized as a through-air drying papermaking fabric. As used herein, "papermaking belt" may be synonymous with "papermaking fabric."

Figure 1:
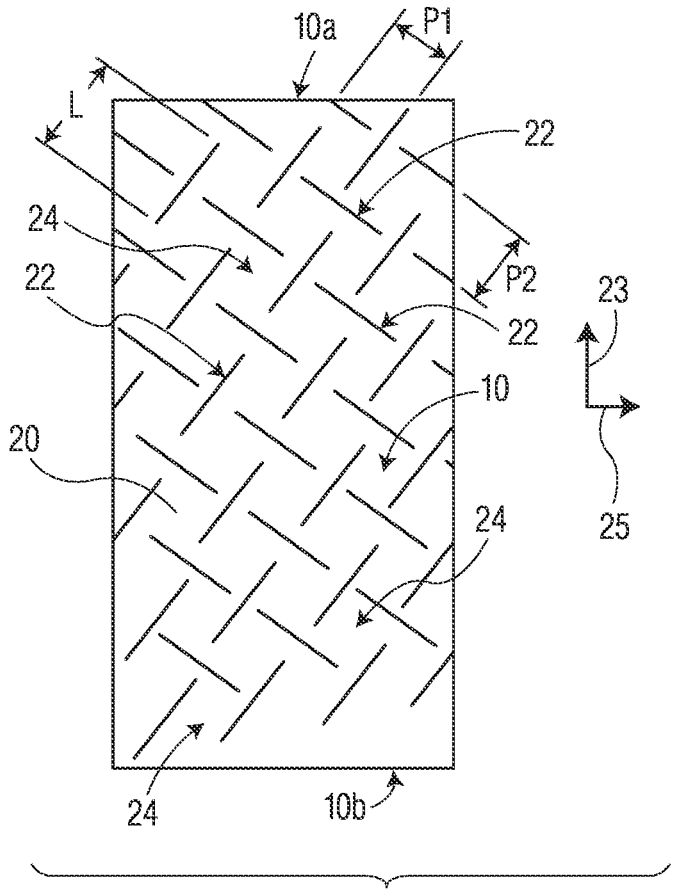
FIG. 1 illustrates a top view of a woven papermaking fabric showing the two machine direction ends of the woven papermaking fabric.
Figure 2:
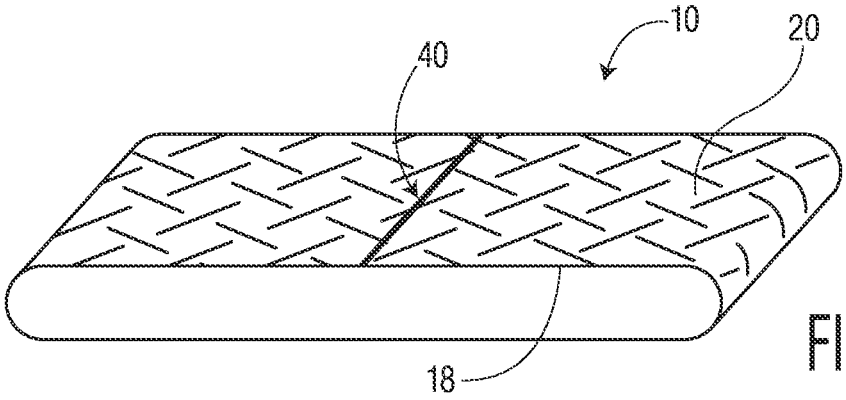
FIG. 2 illustrates the woven papermaking fabric of FIG. 1 including a seam.

FIGS. 1 and 2 illustrate an exemplary woven papermaking fabric 10 of this disclosure. The papermaking fabric 10 can include a plurality of filaments that can be woven together. The papermaking fabric can include a first longitudinal end 10*a* and a second longitudinal end 10*b* that can be joined to form a seam 40 as shown in FIG. 2. As will be described in further detail below, the filaments 12 can include a plurality of warp filaments and a plurality of shute filaments that can be woven together to form a machine contacting side 18 and a web contacting side 20 of the woven papermaking fabric 10. The web contacting side 20 can be opposite from the machine contacting side 18. Machinery employed in a typical papermaking operation is well known in the art and may include, for example, vacuum pickup shoes, rollers, and drying cylinders. In a preferred embodiment, the papermaking fabric 10 comprises a through-air drying fabric useful for transporting an embryonic tissue web across drying cylinders during the tissue manufacturing process. However, in other embodiments, the woven papermaking fabric 10 can comprise a transfer fabric for transporting an embryonic tissue web from forming wires to a through-air drying fabric. In these embodiments, the web contacting side 20 supports the embryonic tissue web, while the opposite surface, the machine contacting side 18, contacts the surrounding machinery.

The web contacting side 20 of the papermaking fabric 10 can include at least one protuberance 22 that cooperates with and structures the wet fibrous web during manufacturing. In preferred embodiments, such as the embodiment illustrated in FIG. 1, the web contacting side 20 of the papermaking fabric 10 can include a plurality of protuberances 22 (only three protuberances 22 labeled in FIG. 1 for purposes of clarity). The protuberances 22 can be discrete or can be continuous. If there are a plurality of protuberances 22, some protuberances 22 can be discrete and some can be continuous. In some embodiments, all of the protuberances 22 can be discrete. In other embodiments, all of the protuberances 22 can be continuous. In some embodiments, particularly embodiments where the papermaking fabric 10 can serve as a through-air drying fabric, the protuberances 22 can form about 5 percent of the surface area of the web contacting side 20, such as from about 5 to about 35 percent, more preferably from about 10 to about 30 percent, even more preferably from about 10 to about 25 percent, and still more preferably from about 20 to about 25 percent of the surface area of the web contacting side 20. In some embodiments, particularly embodiments where the papermaking fabric 10 can serve as a transfer fabric, the protuberances 22 can form about 5 percent of the surface area of the web contacting side 20, such as from about 5 to about 80 percent, more preferably from about 10 to about 70 percent, even more preferably from about 30 to about 50 percent, and still more preferably from about 40 to about 50 percent of the surface area of the web contacting side 20. Of course, it can be appreciated that in some embodiments the protuberances 22 can form a percentage of the surface area of the web contacting side 20 outside of these ranges and still be within the scope of this disclosure.

Figure 6A:
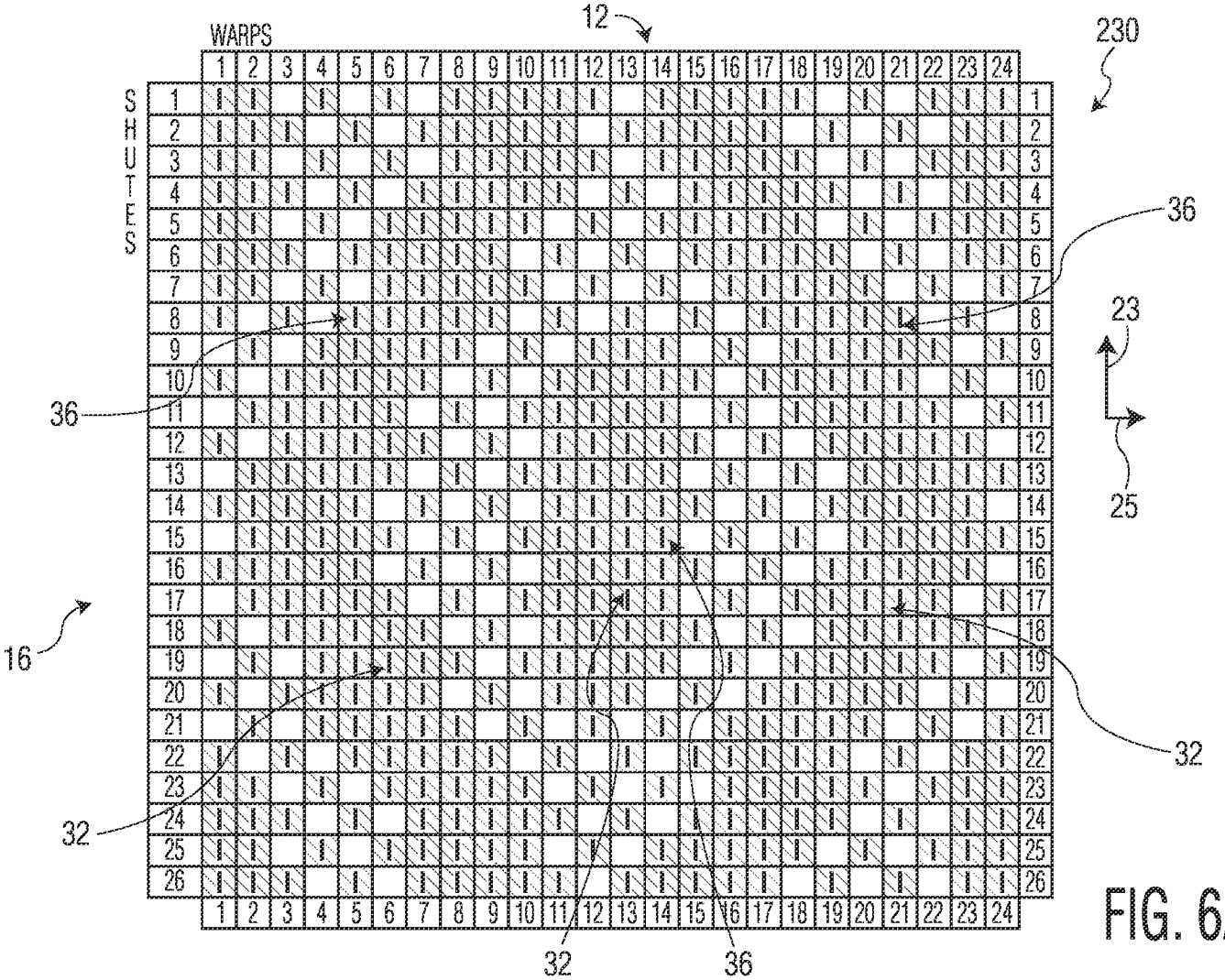
FIG. 6A illustrates a unit cell of a third exemplary weave pattern to produce a papermaking fabric of the present disclosure.
Figure 6B:
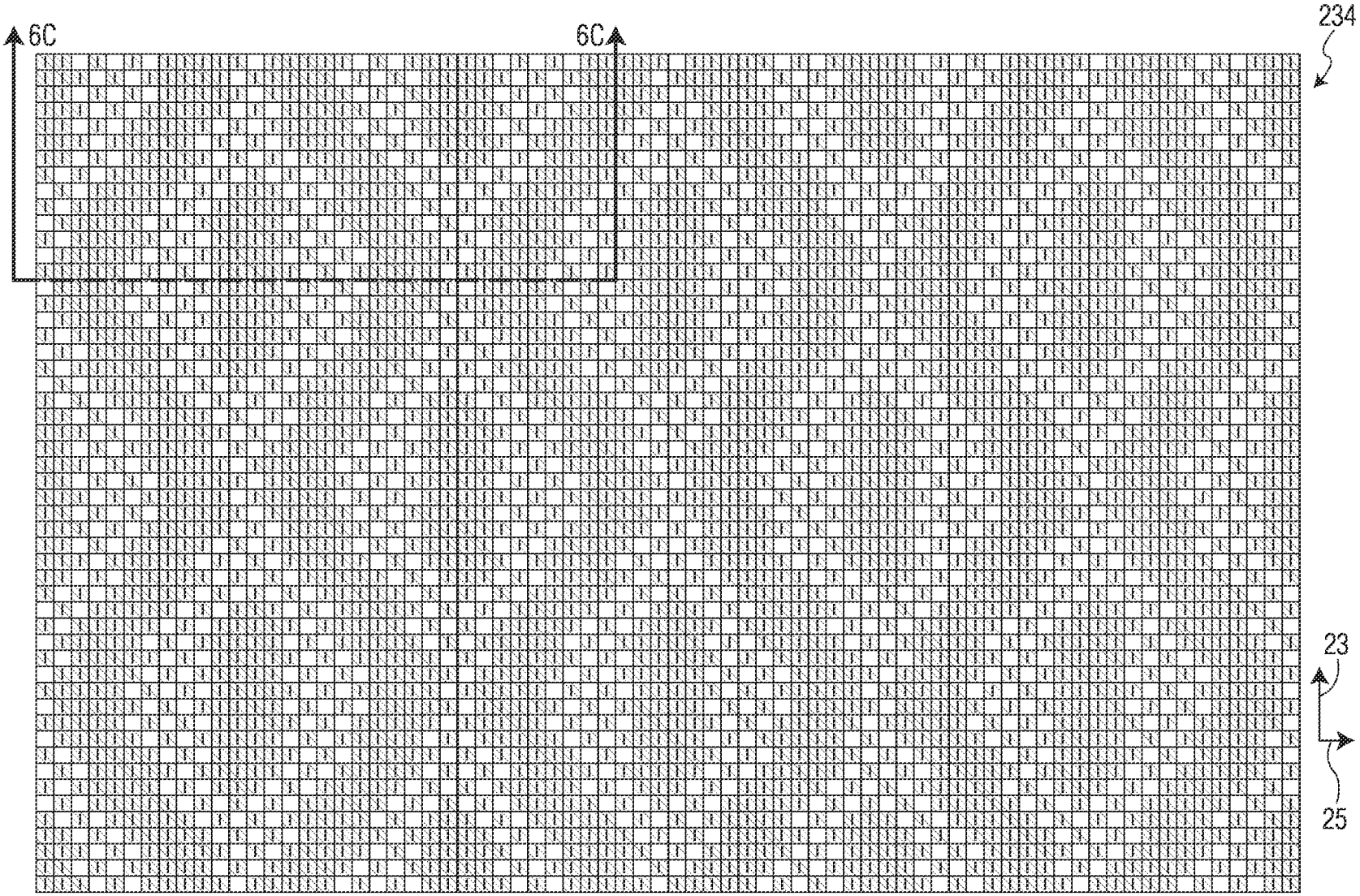
FIG. 6B illustrates an expanded view of the third exemplary weave pattern including several unit cells of FIG. 6A.
Figure 6C:
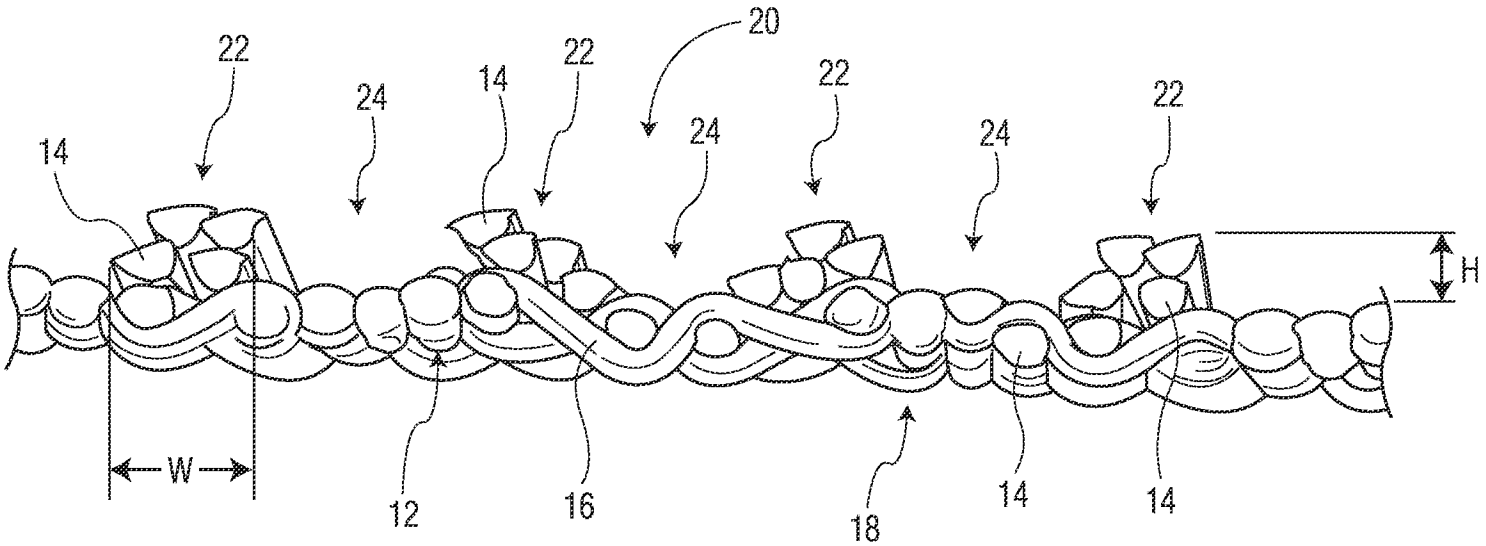
FIG. 6C illustrates a cross-sectional view of an exemplary fabric produced by the weave pattern in FIG. 6B taken along line 6C-6C.

As illustrated in FIG. 1 and FIG. 6C (which shows a cross-sectional image of a portion of an exemplary fabric 10 provided by weave pattern 230 displayed in FIGS. 6A and 6B), the web contacting side 20 can also include at least one landing area 24. In some embodiments, the web contacting side 20 can include a plurality of landing areas 24 (only three landing areas 24 being labeled in FIG. 1 for purposes of clarity). The landing area(s) 24 can surround the protuberances 22, or can be bound by the protuberances 22. Landing areas 24 are generally permeable to liquids and allow water to be removed from the cellulosic fibrous structure by the application of differential fluid pressure, by evaporative mechanisms, or both when drying air passes through the embryonic tissue web while on the papermaking fabric 10 or a vacuum is applied through the papermaking fabric 10. Without being bound by any particularly theory, it is believed that the arrangement of protuberances 22 and landing areas 24 allow the molding of the embryonic web causing fibers to deflect in the z-direction and generate the caliper of, and aesthetic patterns on, the resulting tissue web.

The plurality of protuberances 22 and landing areas 24 can provide a decorative pattern. In the embodiment illustrated in FIG. 1, the protuberances 22 are of the same design, however, it is contemplated that a papermaking fabric 10 can include a plurality of protuberances 22 that include two or more designs. For example, it is contemplated that a protuberance 22 could be linear, arcuate, or sinusoidal in shape, or any other suitable shape. The protuberances 22 can form shapes such as rectangles, squares, circles, ovals, diamonds, etc. The protuberances 22 can form an array of rows and/or columns, and in some embodiments, can be evenly spaced in either or both the machine direction 23 and the cross-machine direction 25. In the embodiment illustrated in FIGS. 1 and 2, the protuberances 22 are discrete and extend in a cross-hatching pattern in which the protuberances 22 converge and diverge upon one another.

As illustrated in the cross-sectional image of a fabric 10 in FIG. 6C, the protuberances 22 can be areas of tightly woven filaments 12. For example, various weave patterns can be configured to provide areas of tightly woven areas and loosely woven areas in which the loosely woven areas push out of plane to create a protuberance 22. Various weave patterns that can provide a stabilized woven papermaking fabric 10 will be described in further detail below. The protuberances 22 can have a height (H) as labeled in FIG. 6C, and as measured from the lowest point in the landing area 24 on the web contacting side 20 to the highest point on the protuberance 22. The height (H) of the protuberances 22 can be of varied size, such as from about 0.1 to about 10.0 mm, more preferably from about 0.2 to about 3.0 mm, or even more preferably from about 0.5 to about 1.1 mm. Of course, it is contemplated that the height (H) can be outside of this preferred range in some embodiments.

Referring back to FIG. 1, the protuberances 22 can also have a length (L). The length (L) is generally measured in the principal dimension of the protuberance 22 in the plane defined by the machine direction 23 and cross-machine direction 25 at a given location. Thus, the length (L) of the protuberance 22 can be measured in the machine direction 23 if the protuberance 22 extends in the machine direction 23 or can be measured in the cross-machine direction 25 if the protuberance 22 extends in the cross-machine direction 25. If the protuberance 22 extends in the machine direction 23, the length (L) of the protuberance 22 could be considered as the entire length of the papermaking fabric 10. The length of some papermaking fabrics 10 may exceed 400 m, and as such, the length (L) of a continuous protuberance 22 extending in the machine direction 23 may be 400 m. Of course, it is contemplated that some papermaking fabrics 10 with continuous protuberances 22 extending in the machine direction 23 may be less than 400 m or may be more than 400 m. In some preferred embodiments for discontinuous protuberances 22, the length (L) can be greater than 0.5 mm such as from about 0.5 to about 100 mm, or from about 0.5 to about 50 mm, or from about 0.5 to about 5.0 mm, or from about 0.5 to about 2.0 mm. Of course, it is contemplated that the length (L) can be outside of this preferred range in some embodiments having discontinuous protuberances 22.

The protuberances 22 can have a width (W), as labeled in FIG. 6C. The width (W) is generally measured normal to the principal dimension of the protuberance 22 in a plane defined by the machine direction 23 and cross-machine direction 25 at a given location. Where the protuberance 22 has a generally square or rectangular cross-section, the width (W) is generally measured as the distance between the two planar sidewalls that form the protuberance 22. In those cases where the protuberance 22 does not have planar sidewalls such as in the embodiment depicted in FIG. 6C, the width (W) is measured at the point that provides the greatest width for the configuration of the protuberance 22. In this example, the width (W) could be measured along the base of the protuberance 22. In some preferred embodiments, the width (W) of the protuberances 22 can be from about 0.1 to about 20 mm, or preferably from about 0.2 to about 10.0 mm, or even more preferably from about 0.3 to about 3.0 mm. Of course, it is contemplated that the width (W) can be outside of the preferred range in some embodiments and still be within the scope of this disclosure.

If a papermaking fabric 10 includes multiple protuberances 22, it is contemplated that a plurality of or all of the protuberances 22 can be configured substantially the same in terms of any one or more characteristics of height (H), width (W), or length (L). It is also contemplated that a papermaking fabric 10 can be configured with protuberances 22 configured such that one or more characteristics of height (H), width (W), or length (L) of the protuberances 22 vary from one protuberance 22 to another protuberance 22.

The spacing and arrangement of protuberances 22 may vary depending on the desired properties and topographies of the papermaking fabric 10 if being utilized as a transfer fabric, or the desired properties and appearance of the tissue web if being used as a through-air drying fabric. In some embodiments, the protuberances 22 can be spaced apart across the entire cross-machine direction 25 length of the papermaking fabric 10. Additionally or alternatively, the protuberances 22 can be configured to extend in the cross-machine direction 25 of the papermaking fabric 10 and can be spaced apart from adjacent protuberances in the machine direction 23. Of course, the direction of the protuberance 22 alignments (machine direction, cross-machine direction, or diagonal) discussed above refer to the principal alignment of the protuberances 22. Within each alignment, the protuberances 22 may have segments aligned at other directions, but aggregate to yield the particular alignment of the entire protuberances 22.

Generally the protuberances 22 are spaced apart from one another so as to define a landing area 24 there-between. In use as a through-air drying fabric, the embryonic tissue web is formed as fibers are deflected in the z-direction by the protuberances 22. The spacing of protuberances 22 can be provided such that the tissue web conforms to the surface of the papermaking fabric 10 without tearing. If the individual landing areas 24 are too large the resulting sheet can have insufficient cross-machine direction strain, cross-machine direction stretch, and be of poor quality. Conversely, if the spacing between adjacent protuberances 22 is too small the tissue will not mold into the landing areas 24 and could result in reduced cross-machine direction strain, cross-machine direction stretch, and poor quality, and potentially, could rupture the tissue web.

If protuberances 22 are generally aligned in one direction, the center-to-center spacing between adjacent protuberances 22 can be defined as the pitch (P) of the protuberances 22. In some embodiments, such as the embodiment depicted in FIGS. 1 and 2, the protuberances 22 can be configured such that they are generally aligned in two different directions. As such there can be two different pitch measurements P1 and P2. In such an embodiment, the pitches P1 and P2 for each direction of alignment of protuberances 22 can be the same, or can be different. The pitch (P) can be in either the machine direction 23, the cross-machine direction 25, or some diagonal direction, as illustrated in FIG. 1. Regardless of the direction of the alignment of the protuberances 22, the pitch (P) can be greater than about 1.0 mm, such as from about 1.0 to about 20 mm apart and more preferably from about 2.0 to about 10 mm apart. In one particularly preferred embodiment where the papermaking fabric is used as a transfer fabric, the protuberances 22 can be spaced apart from one another from about 1.5 to about 4.0 mm apart. This spacing can result in a tissue web which generates maximum caliper and cross-machine direction strain when made of conventional cellulosic fibers. In one embodiment where the papermaking fabric is used as a through-air drying fabric, the protuberances 22 can be spaced apart from one another from about 2.0 to about 4.4 mm apart. This arrangement can provide a tissue web having three-dimensional surface topography, yet relatively uniform density.

The preferred pitch (P) can be selectively designed to correspond with the height (H) of the protuberances 22. In one preferred embodiment for a through-air drying fabric, a pitch (P) of about 3.8 to about 4.4 mm can be preferred for protuberances 22 having a height (H) of about 0.8 to about 1.0 mm. In one embodiment, the pitch (P) can be about 2.0 mm and the height (H) can be about 0.5 mm. Thus, in some preferable embodiments, it is preferred to have a ratio of pitch (P) to protuberance 22 height (H) between about 4/1 to about 5/1. As another example, in one preferred embodiment of a transfer fabric, a pitch (P) of about 7.6 mm can be preferred for protuberances 22 having a height (H) of about 1.9 mm. Thus, in one preferable embodiment, it is preferred to have a ratio of pitch (P) to protuberance 22 height (H) be about 4/1. Of course, it is contemplated that the ratio of pitch (P) to protuberance 22 height (H) can be outside these ranges and still be within the scope of this disclosure.

In other contemplated embodiments, the pitch (P) in the machine direction 23 and/or the cross-machine direction 25 can vary throughout the machine direction 23 and/or cross-machine direction 25, respectively. Regardless of the particular pattern of protuberances 22, or whether adjacent patterns are in or out of phase with one another, the protuberances 22 can be separated from one another by some minimal distance. Preferably the distance between continuous protuberances 22 is greater than 0.5 mm and in a particularly preferred embodiment greater than about 1.0 mm, and still more preferably greater than about 2.0 mm such as from about 2.0 to about 8.0 mm.

It is also contemplated that the protuberances 22 could be wave-like or sinusoidal such that the protuberances 22 have an amplitude and a wavelength. In such embodiments, the amplitude can range from about 2.0 to about 200 mm, in a particularly preferred embodiment from about 10 to about 40 mm and still more preferably from about 18 to about 22 mm. Similarly, the wavelength could range from about 20 to about 500 mm, in a particularly preferred embodiment from about 50 to about 200 mm and still more preferably from about 80 to about 120 mm. In an especially preferred embodiment, the wavelength can be about 100 mm and the amplitude can be about 10 mm.

Exemplary weave patterns and methods of manufacturing a woven papermaking fabric 10 will now be described. In one embodiment, the papermaking fabric 10 could be manufactured by providing a first set of filaments and a second set of filaments that are woven in a weave pattern 30. The first set of filaments can serve as warp filaments 14 in a loom and the second set of filaments can serve as shute filaments 16 in a loom. The method can additionally include weaving the shute filaments 16 with the warp filaments 14 in a lateral direction 25 to provide a web contacting side 20 of the woven papermaking fabric 10 and a machine contacting side 18 of the woven papermaking fabric 10 and to provide at least one protuberance 22 on the web contacting side 20 of the woven papermaking fabric 10. Weaving the shute filaments 16 with the warp filaments 14 can be accomplished according to following a weave pattern 30.

Figure 3B:
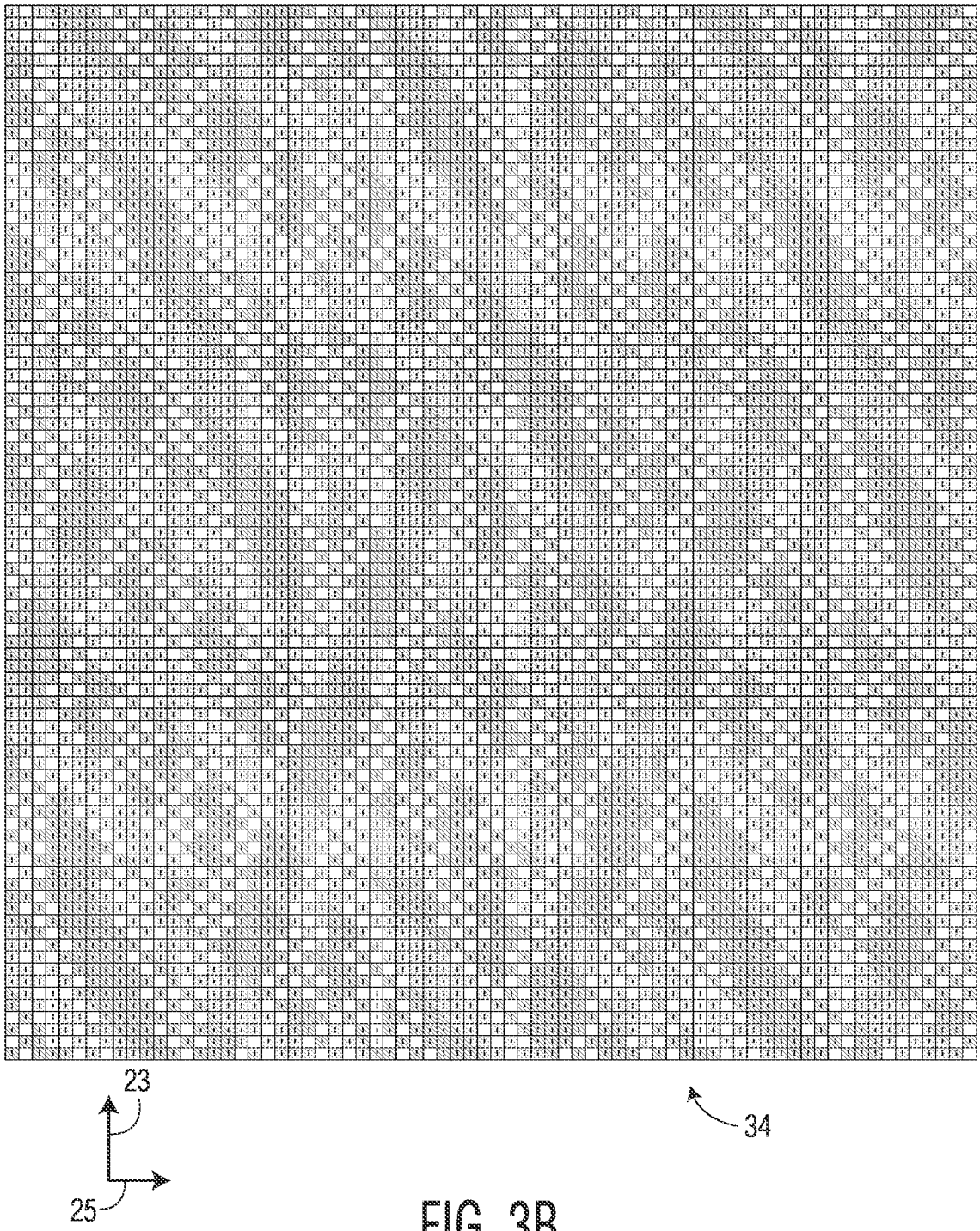
FIG. 3B illustrates an expanded view of the first exemplary weave pattern including several unit cells of FIGS. 3A1-3A3.
Figure 5A:
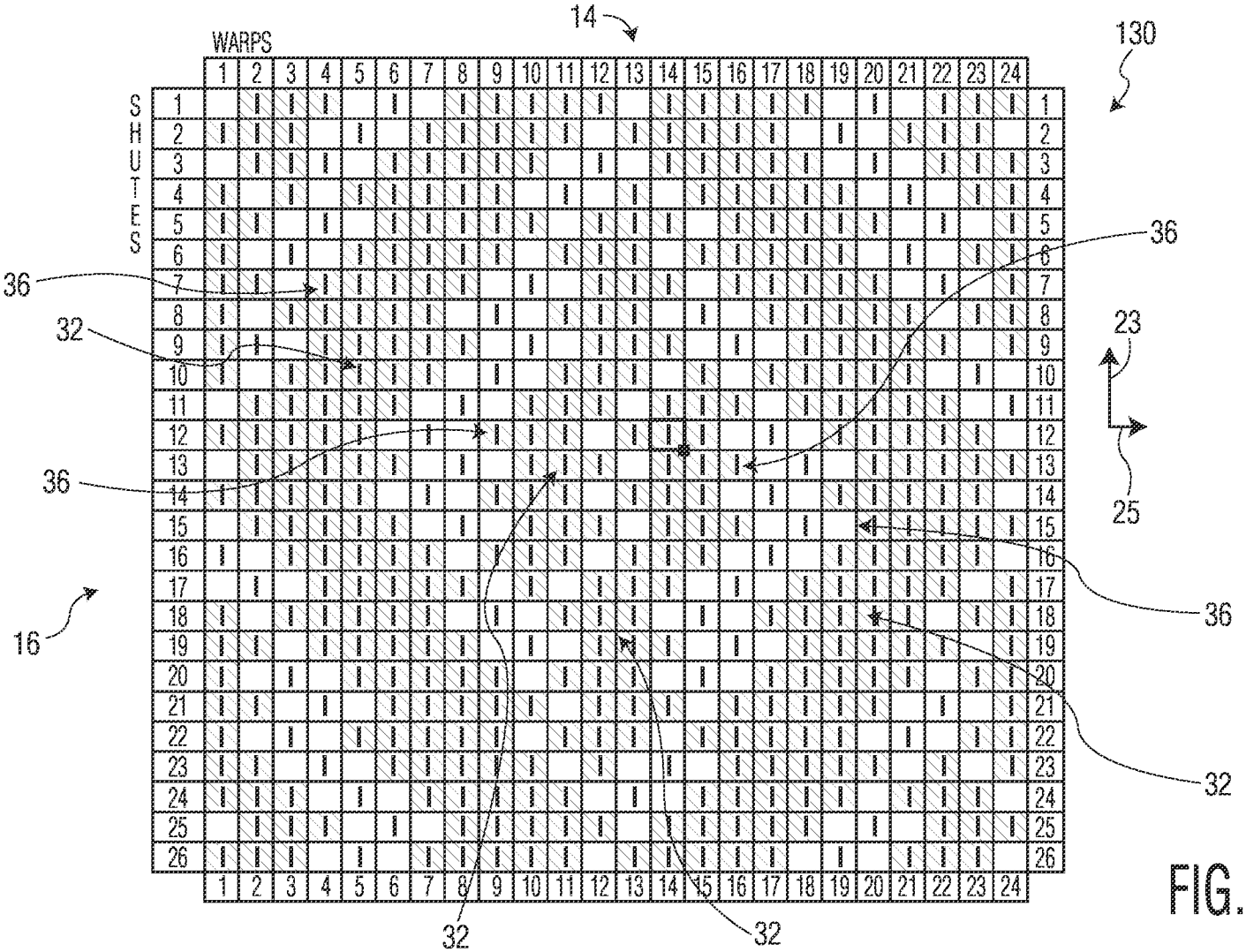
FIG. 5A illustrates a unit cell of a second exemplary weave pattern to produce a papermaking fabric of the present disclosure.
Figure 5B:
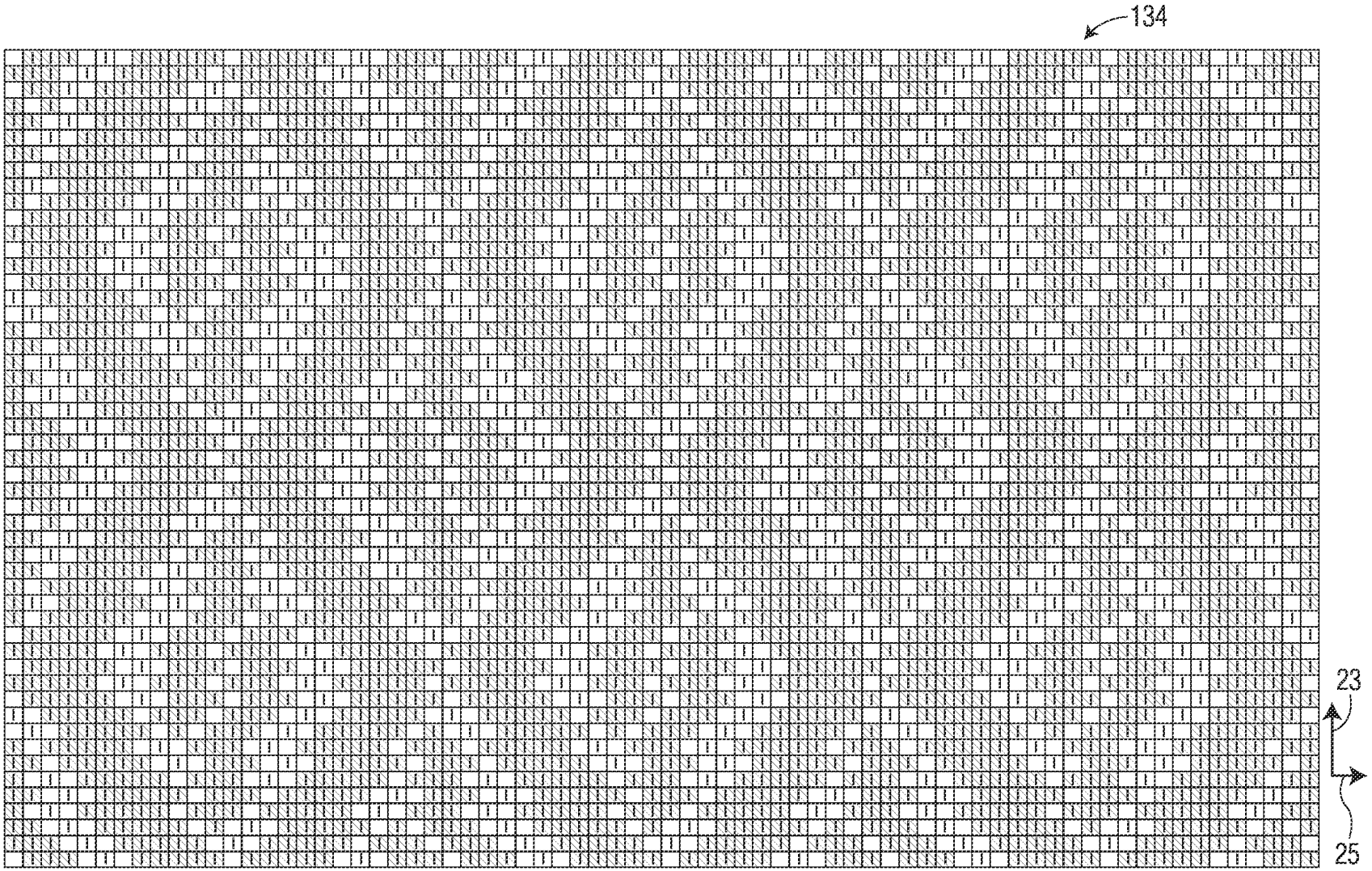
FIG. 5B illustrates an expanded view of the second exemplary weave pattern including several unit cells of FIG. 5A.
Figure 7A:
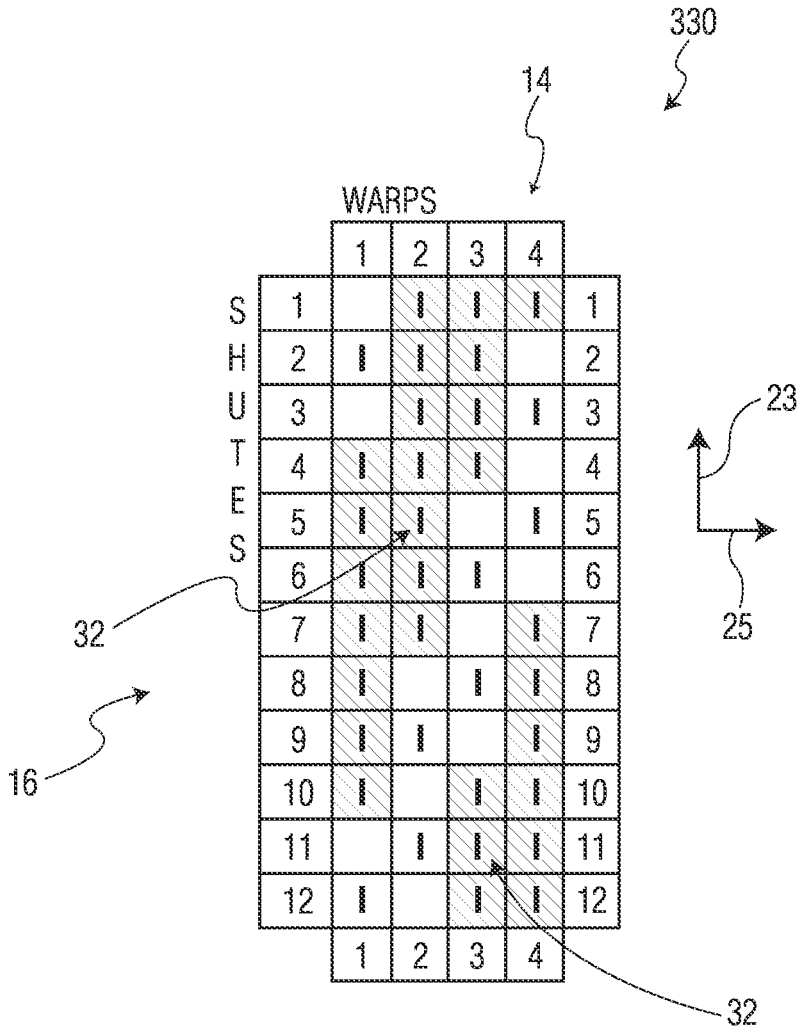
FIG. 7A illustrates a unit cell of a fourth exemplary weave pattern to produce a papermaking fabric of the present disclosure.
Figure 7B:
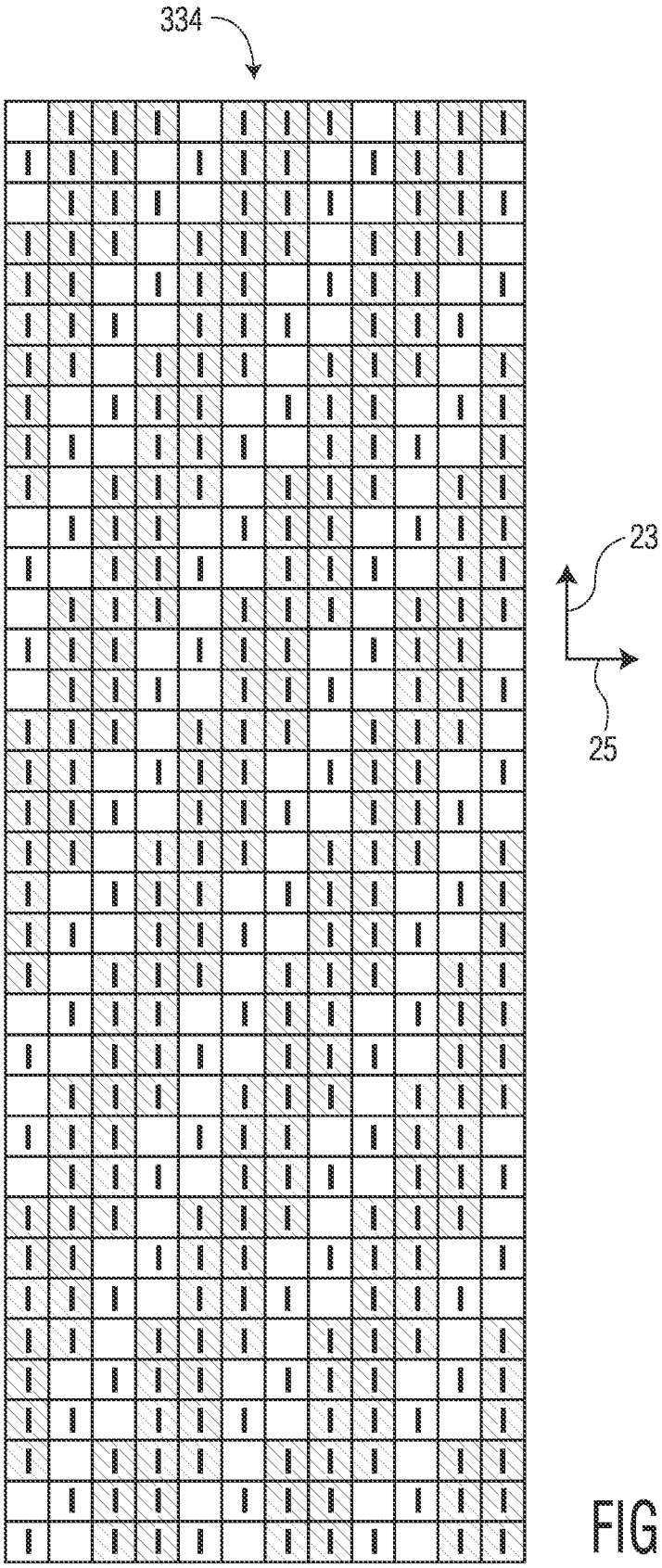
FIG. 7B illustrates an expanded view of the fourth exemplary weave pattern including several unit cells of FIG. 7A.

Various weave patterns 30, 130, 230, 330 can be used to guide the weaving of the shute filaments 16 with the warp filaments 14 and provide at least one protuberance 22 that is stabilized on the papermaking fabric 10. Unit cells for weave patterns 30, 130, 230, 330 are shown in FIGS. 3A1-3A3, 5A, 6A, and 7A, respectively. The unit cell of FIGS. 3A1-3A3 is a single unit cell, but is separated onto three separate pages to provide proper clarity for the weave pattern 30. Unit cells can be repeated as many times as desired in the machine direction 23 and/or the cross-machine direction 25 to form a desired pattern in a papermaking fabric 10. As an example, FIG. 3B shows several unit cells of the weave pattern 30 of FIGS. 3A1-3A3 combined to provide an example of how several unit cells can be combined to provide a larger pattern 34 for a papermaking fabric 10. FIGS. 5B, 6B, and 7B show several unit cells of respective weave patterns 130, 230, 330 of FIGS. 5A, 6A, and 7A, respectively, to show how several unit cells of weave patterns 130, 230, 330 can be combined to provide larger patterns 134, 234, 334, respectively. If the patterns 34, 134, 234, 334 are used to provide a papermaking fabric 10 used as a through-air drying fabric, the tissue web can incorporate the patterns 34, 134, 234, 334 and the decorative elements provided thereby.

The weave pattern 30 of FIGS. 3A1-3A3 will now be described in detail, however, the principles of weave pattern 30 are applicable to the weave patterns 130, 230, 330 of FIGS. 5A, 6A, 7A, respectively, unless otherwise noted. The unit cell of weave pattern 30 of FIGS. 3A1-3A3 can include a plurality of warp filaments 14 generally aligned in the machine direction 23 and a plurality of shute filaments 16 generally aligned in the cross-machine direction 25. For the weave pattern 30 illustrated in FIGS. 3A1-3A3, the weave pattern 30 can be configured on a loom (not pictured) such that the web contacting side 20 of the papermaking fabric 10 (as labeled in FIG. 1) will be facing out from the page, and the machine contacting side 18 of the papermaking fabric 10 (as labeled in FIG. 2) will be facing into the page. Of course, it is contemplated that a weave pattern 30 could be configured in the opposite orientation on a loom. Each interchange of a specific warp filament 14 and a specific shute filament 16 of the weave pattern 30 that includes a vertical line segment (or a capital letter "I") provides a notation that the specific warp filament 14 is woven above the specific shute filament 16 at that interchange. For example, the interchange of warp filament No. 1 and shute filament No. 1 includes such a vertical line segment in FIG. 3A1, and thus, warp filament No. 1 is woven above shute filament No. 1. In some circumstances interchanges of warp filaments 14 and shute filaments 16 that have the vertical line segment (or capital letter "I") that will lead to the development of a protuberance 22 are also shaded with a cross-hatching pattern for purposes of clarity of perceiving the protuberances 22 of the weave patterns 30, 130, 230, 330 provided herein.

The weave pattern 30 can be configured to provide at least one protuberance 22 (as labeled in FIG. 1 and described above) that can be provided by a protuberance forming area 32. For purposes, herein, a "protuberance forming area" is a continuous area in the weave pattern 30 in which a plurality of adjacent warp/shute filament interchanges are woven such that the warp filaments 14 are woven above their respective shute filaments 16. Protuberance forming areas 32 can be of various lengths and/or widths to provide various shapes. As shown in FIGS. 3A1-3A3, the weave pattern 30 includes five distinct protuberance forming areas 32 that each individually form a generally linear segment in shape that is oriented at an angle with respect to the machine direction 23 and the cross-machine direction 25. It is contemplated that the protuberance forming areas 32 can form a variety of shapes, including, but not limited to, arcs, circles, ovals, rectangles, squares, diamonds, etc. The protuberance forming areas 32 of the weave pattern 30 include diagonally oriented protuberance forming areas 32 that are aligned such that the protuberance forming areas 32 converge upon one another. In other words, the protuberance forming areas 32 in the weave pattern 30 of FIGS. 3A1-3A3 are not parallel to one another. However, it is contemplated that in some embodiments, the protuberance forming areas 32 can be parallel to one another. For example, the weave pattern 330 of FIG. 7A illustrates protuberance forming areas 32 that form generally linear segments that are parallel to one another.

Upon completion of the papermaking fabric 10, the design and layout of the protuberance forming area(s) 32 can provide the design and layout of the protuberance(s) 22 and land area(s) 24. In the weave pattern 30 illustrated in FIG. 3A1-3A3, the protuberance forming areas 32 develop into protuberances 22 in the papermaking fabric 10 as the fabric 10 is being formed on a loom, and the area between protuberance forming areas 32 can provide the land areas 24 (as labeled in FIG. 1) in the papermaking fabric 10. The topography of the protuberances 22 and land areas 24 can be further affected by any heat set provided to the papermaking fabric 10. The weave pattern 30 can be constructed such that the protuberance 22 can extend longitudinally over at least five shute filaments 16. In some embodiments, the protuberance 22 can extend longitudinally over at least ten shute filaments 16, or at least fifteen shute filaments 16, or at least twenty-five shute filaments 16, or more. For example, the largest protuberance forming area 32 in the unit cell for weave pattern 30 in FIGS. 3A1-3A3 that can provide a protuberance 22 upon completion of the papermaking fabric 10 extends in a diagonal fashion over 50 shute filaments 16. The weave pattern 30 can be constructed such that the protuberance 22 can extend laterally over various amounts of shute filaments 16 to provide a width (W) of the protuberance 22 as described above. The weave pattern 30 can be configured such that the protuberance forming area 32 can laterally extend over at least three warp filaments in a cross-machine direction 25. In some embodiments, the weave pattern can be configured such that the protuberance forming area 32 can laterally extend over at least five warp filaments 14 in a cross-machine direction 25, or at least ten warp filaments 14, or at least twenty-four warp filaments 14.

Figure 3C:
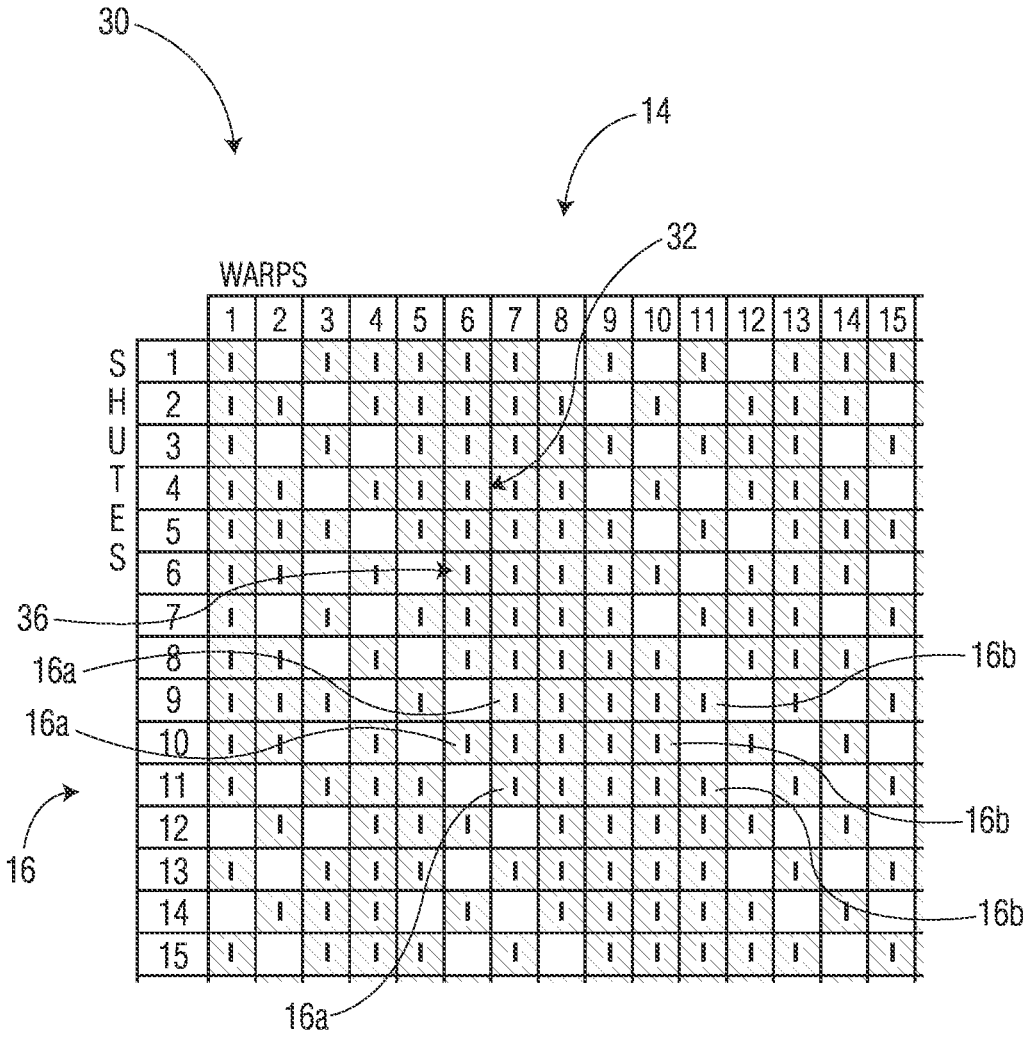
FIG. 3C illustrates a detailed view of a portion of the unit cell of the first exemplary weave pattern in FIGS. 3A1-3A3.

As depicted in the detailed view of FIG. 3C, each shute filament 16 that forms part of a protuberance forming area 32 can include a float proximal end 16*a* and a float distal end 16*b* in a cross-machine direction 25. Looking at a specific shute filament 16 within the weave pattern 30 in a left-to-right fashion, the float proximal end 16*a* can be the interchange of a specific shute filament 16 and a specific warp filament 14 that begins a series of adjacent interchanges in which the warp filaments 14 are woven above that specific shute filament 16. The float distal end 16*b* can be the interchange of a specific shute filament 16 and a specific warp filament 14 that ends a series of adjacent interchanges in which the warp filaments 14 are woven above that specific shute filament 16. In other words, a shute filament 16 float proximal end 16*a* can be where the shute filament 16 is woven from a web contacting side 20 to the machine contacting side 18 of the fabric 10 and a shute filament 16 float distal end 16*b* can be where the shute filament is woven from a machine contacting side 18 to the web contacting side 20 of the fabric. Thus, the weave pattern 30 for a specific shute filament 16 between a float proximal end 16*a* and a float distal end 16*b* can be pictured such that each successive warp filament 14 is woven above that specific shute filament 16. In other words, a shute filament 16 is woven below each warp filament 14 between the float proximal end 16*a* and the float distal end 16*b*. FIG. 3C labels the float proximal end 16*a* and the respective float distal end 16*b* for three successive shute filaments 16 (shute filament nos. 9, 10, 11).

As illustrated in FIGS. 3A1-3A3 and FIG. 3C, the weave pattern 30 is configured such that the protuberance(s) 22 formed by the protuberance forming area(s) 32 are stabilized by including an offset shute float weave pattern 36. The offset shute float weave pattern 36 can be configured such that a majority of the shute filaments 16 that form a protuberance 22 (formed by a respective protuberance forming area 32) are woven to be in an anti-nesting configuration. As used herein, "anti-nesting" means that a float in a respective shute filament 16 is precluded from nesting within floats provided by both adjacent shute filaments 16.

Figure 4:
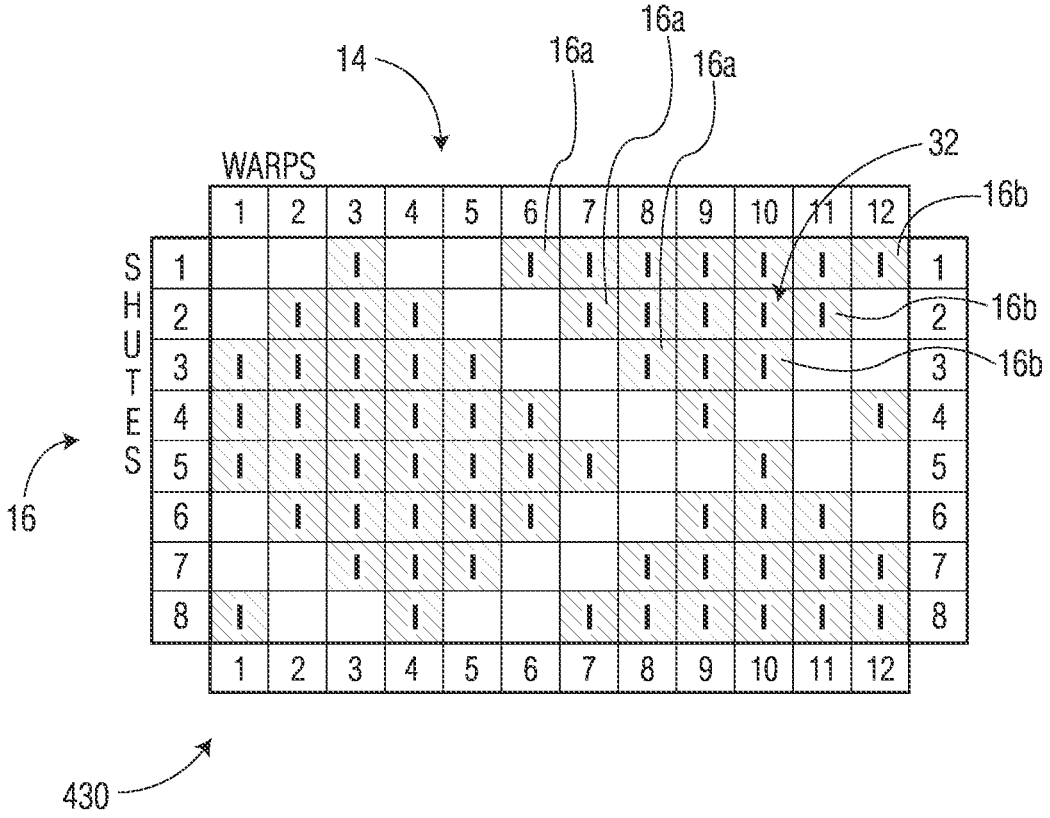
FIG. 4 PRIOR ART
FIG. 4 illustrates a unit cell of a prior art weave pattern.

The anti-nesting provided by the offset shute float weave pattern 36 can be further understood by reviewing the detailed view of FIG. 3C and the three successive shute filaments nos. 9, 10, and 11 and comparing to a prior art weave pattern 430 illustrated in FIG. 4. As labeled for the shute filaments nos. 9, 10, and 11 in FIG. 3C, each shute filament 16 forming a portion of a protuberance 22 can include a float proximal end 16*a* and a float distal end 16*b*. Looking at shute filament no. 10, the float proximal end 16*a* of shute filament no. 10 is laterally offset from the float proximal end 16*a* of shute filament no. 9 and the float distal end 16*b* of shute filament no. 10 is laterally offset from the float distal end 16*b* of shute filament no. 9. Importantly, the lateral offset of the float proximal end 16*a* and the float distal end 16*b* of shute filament no. 10 with the respective float ends 16*a*, 16*b* of shute filament no. 9 is staggered such that one end (float proximal end 16*a* or float distal end 16*b*) of shute filament no. 10 is laterally outside of the respective float end 16*a*, 16*b* of shute filament no. 9 and the other end of shute filament no. 10 (float proximal end 16*a* or float distal end 16*b*) is laterally inside the respective end 16*a*, 16*b* of shute filament no. 9. For example, the float proximal end 16*a* of shute filament no. 10 is laterally outside of the float proximal end 16*a* of shute filament no. 9, and the float distal end 16*b* of shute filament no. 10 is laterally inside of the float distal end 16*b* of shute filament no. 9. Having this staggered lateral offset on the float proximal end 16*a* and the float distal end 16*b* of shute filament no. 10 as compared to the respective float ends 16*a*, 16*b* of shute filament no. 9 prevents the portion of shute filament no. 10 that forms a portion of the protuberance 22 from nesting within the portion of shute filament no. 9 that forms a portion of the protuberance 22, and vice versa.

Additionally, the float proximal end 16*a* of shute filament no. 10 is laterally offset from the float proximal end 16*a* of shute filament no. 11 and the float distal end 16*b* of shute filament no. 10 is laterally offset from the float distal end 16*b* of shute filament no. 11 in a staggered fashion as well. Specifically, the float proximal end 16*a* of shute filament no. 10 is laterally outside of the float proximal end 16*a* of shute filament no. 11 and float distal end 16*b* of shute filament no. 10 is laterally inside of the float distal end 16*b* of shute filament no. 11. As noted above with respect to shute filament nos. 9 and 10, this staggered lateral offset for the float proximal end 16*a* and the float distal end 16*b* of shute filament no. 10 in regard to the respective float ends 16*a*, 16*b* of shute filament no. 11 prevents the portion of shute filament no. 10 that forms a portion of the protuberance 22 from nesting within the portion of shute filament no. 11 that forms a portion of the protuberance 22, and vice versa.

The benefits of the anti-nesting configuration of weave pattern 30 of FIG. 3C can be understood further by referring to the weave pattern 430 of the prior art as illustrated by the unit cell of FIG. 4. The weave pattern 430 of FIG. 4 does not demonstrate an offset shute float weave pattern with a majority of the shute filaments 16 forming a protuberance 22 (formed by protuberance forming area 32) being woven in an anti-nesting configuration. Instead, weave pattern 430 of FIG. 4 demonstrates a majority of shute filaments 16 forming a protuberance 22 (formed by protuberance forming area 32) being woven in a nesting configuration. Specifically, shute filaments nos. 1, 2, and 3 will be referred to as they form a protuberance forming area 32 in the upper right-hand portion of weave pattern 430. Shute filament nos. 1, 2, and 3 each include a float proximal end 16*a* and float distal end 16*b*. The float proximal end 16*a* of shute filament no. 2 is laterally inside of the float proximal end 16*a* of shute filament no. 1 and the float distal end 16*b* of shute filament no. 2 is also laterally inside of the float distal end 16*b* of shute filament no. 1. By having both the float proximal end 16*a* and the float distal end 16*b* each be laterally inside of the respective float ends 16*a*, 16*b* of adjacent shute filament no. 1, shute filament no. 2 is in a nesting configuration. That is, the portion of shute filament no. 2 that forms a portion of protuberance forming area 32 (and will form a portion of a protuberance 22) can nest inside of the portion of shute filament no. 1 that forms a portion of protuberance forming area 32 (and will form a portion of a protuberance 22).

Similarly, shute filament no. 3 of weave pattern 430 in FIG. 4 is also configured in a nesting configuration with adjacent shute filament no. 2. The float proximal end 16*a* of shute filament no. 2 is laterally outside of the float proximal end 16*a* of shute filament no. 3 and the float distal end 16*b* of shute filament no. 2 is laterally outside of the float distal end 16*b* of shute filament no. 3. By having both the float proximal end 16*a* and the float distal end 16*b* of shute filament no. 2 be laterally outside of the respective float ends 16*a*, 16*b* of adjacent shute filament no. 3 provides a nesting configuration in which the portion of shute filament no. 3 that forms a portion of protuberance forming area 32 (and will form a portion of a protuberance 22) can nest inside of the portion of shute filament no. 2 that forms a portion of protuberance forming area 32 (and will form a portion of a protuberance 22).

Importantly, by incorporating an offset shute float weave pattern 36 that has a majority of the shute filaments 16 forming a protuberance 22 be configured in an anti-nesting configuration, stability is provided to the protuberance 22 formed by the weave pattern 30. As discussed above, the anti-nesting configuration prevents adjacent shute filaments 16 that define a protuberance forming area 32 (and that will form a protuberance 22) from collapsing upon one another. Another benefit to the offset shute float weave pattern 36 is the ability to form protuberance forming areas 32 that provide stabilized protuberances 22 that converge and diverge upon one another, such as that shown in FIGS. 3A1-3A3, and as seen in the expanded configuration of FIG. 3B. Thus, a larger variety of decorative patterns can be configured with an offset shute float weave pattern 36 that is configured to have a majority of shute filaments 16 in an anti-nesting configuration.

The offset shute float weave pattern 36 can have variances in different embodiments. For example, in preferred embodiments, the amount of lateral offset between respective float proximal ends 16*a* or respective float distal ends 16*b* in adjacent shute filaments 16 can be the spacing of one warp filament 14, such as that shown in FIG. 3C. In other embodiments, the amount of lateral offset between respective float proximal ends 16*a* or respective float distal ends 16*b* in adjacent shute filaments 16 can be the spacing of more than one warp filament 14. For example, the amount of lateral offset between respective float proximal ends 16*a* and/or respective float distal ends 16*b* in adjacent shute filaments 16 can be two, or three, or four, or five warp filaments 14.

In preferred embodiments, such as the weave patterns 30, 130, 230, and 330 as described and illustrated herein, substantially all of the shute filaments 16 that form a portion of a protuberance 22 (formed by a respective protuberance forming area 32) are woven in an anti-nesting format as described above.

Figure 8A:
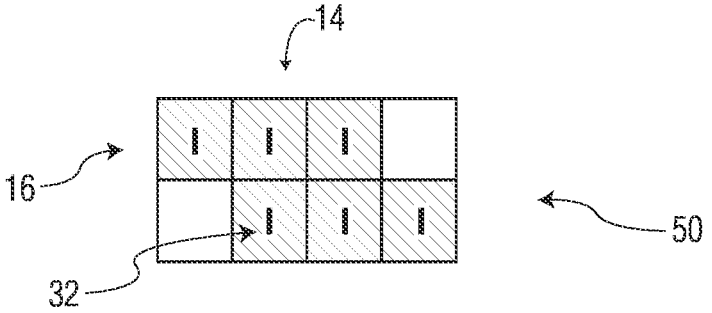
FIGS. 8A-18D illustrate various base structures that can be selected for use in a stabilized weave pattern for a papermaking fabric of the present disclosure.
Figure 8B:
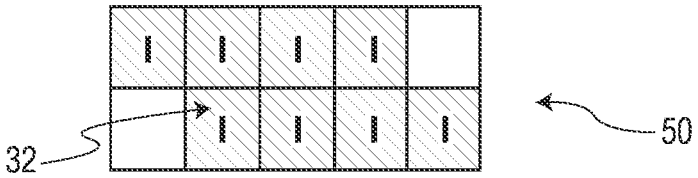
Figure 8C:
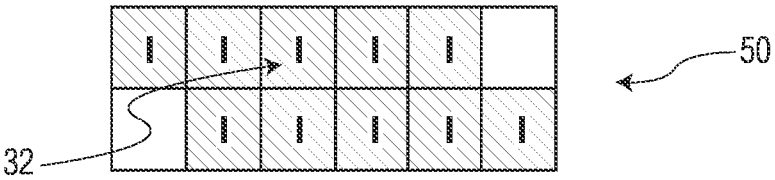
Figure 8D:
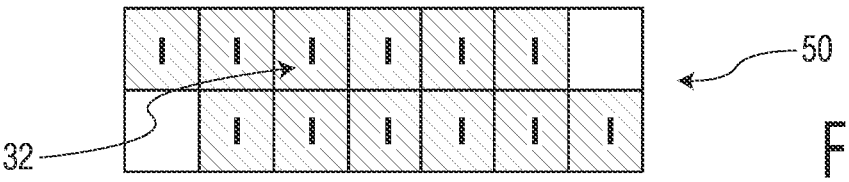
Figure 8E:
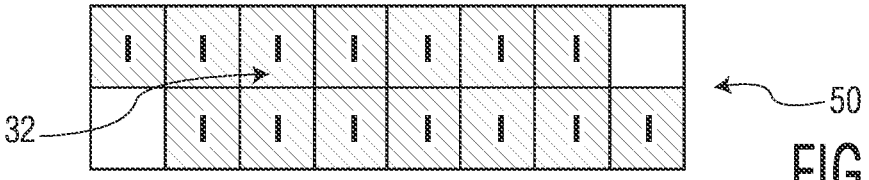
Figure 9A:
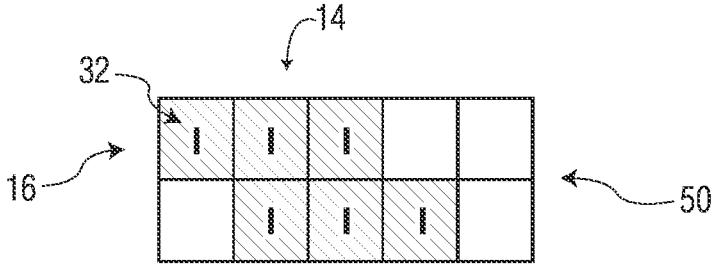
Figure 9B:
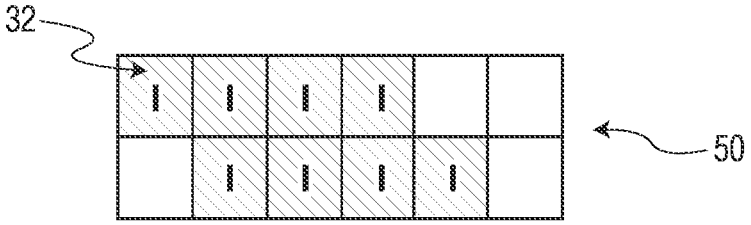
Figure 9C:
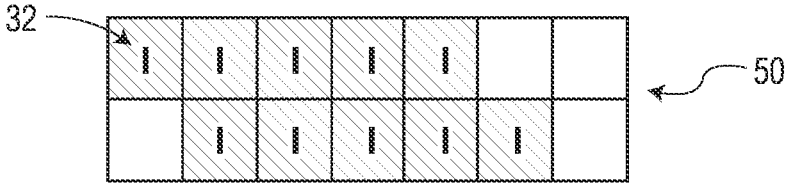
Figure 9D:
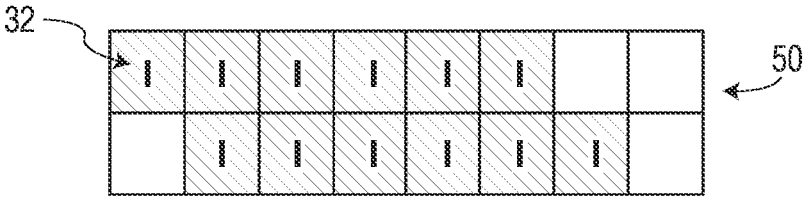
Figure 9E:
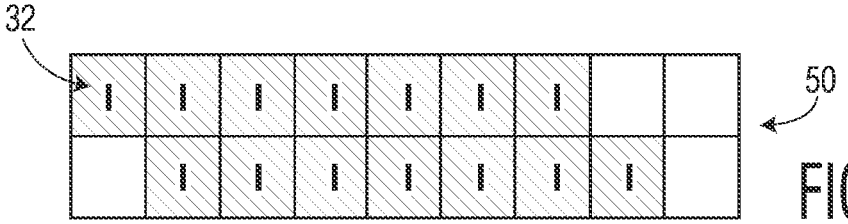
Figure 10A:
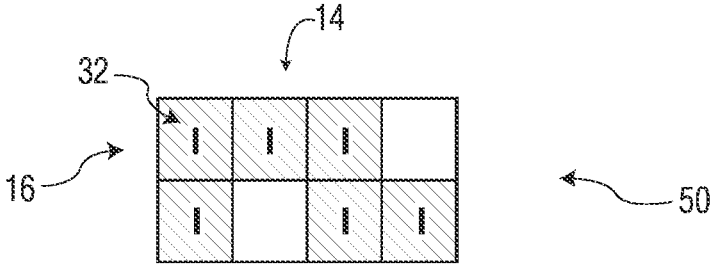
Figure 10B:
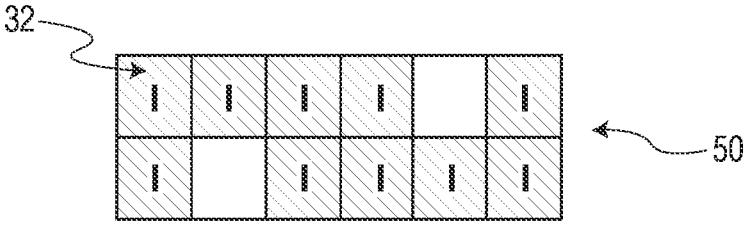
Figure 10C:
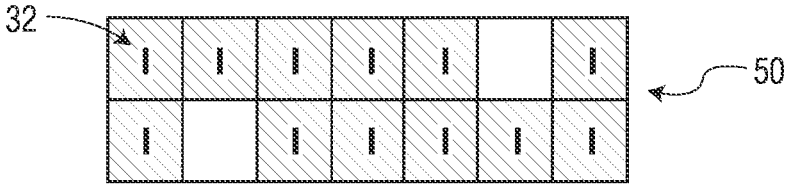
Figure 10D:
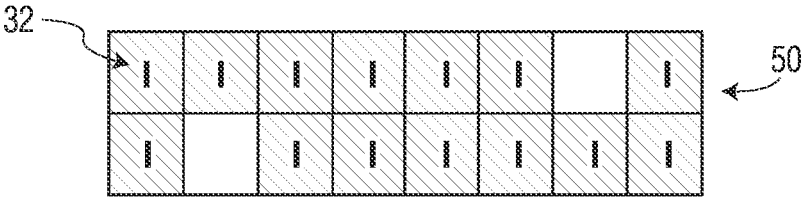
Figure 10E:
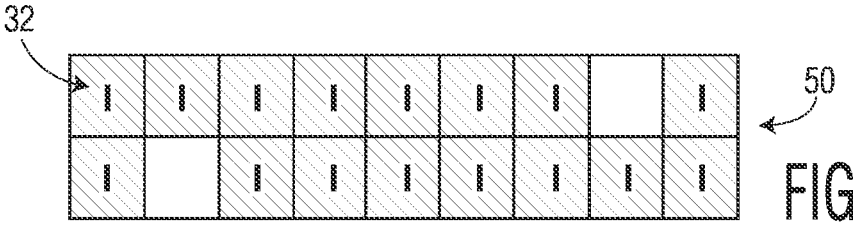
Figure 11A:
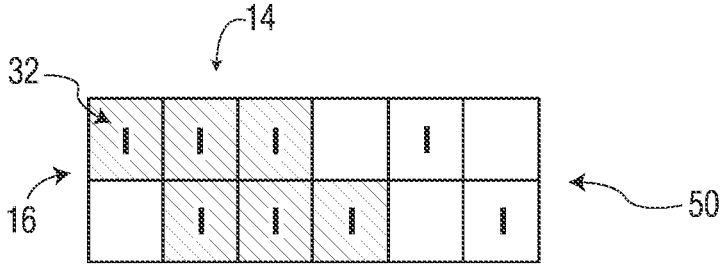
Figure 11B:
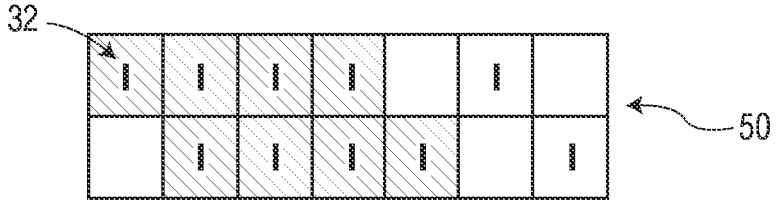
Figure 11C:
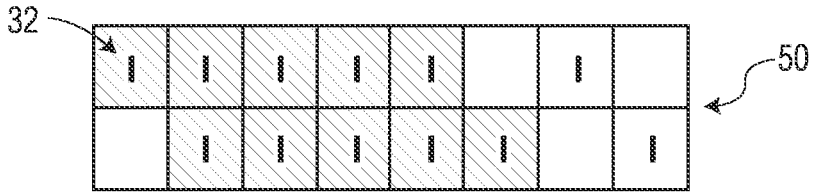
Figure 11D:
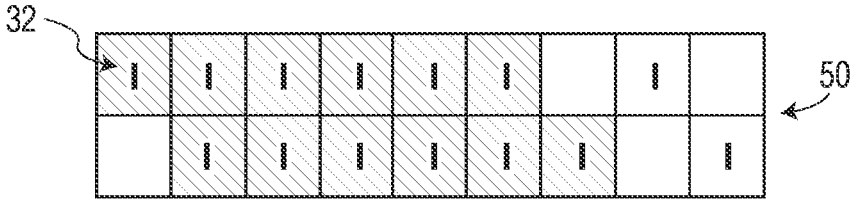
Figure 11E:
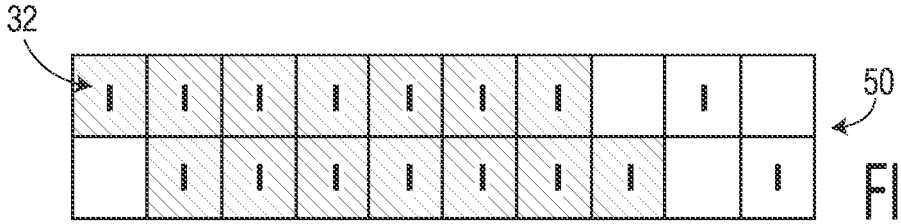
Figure 12A:
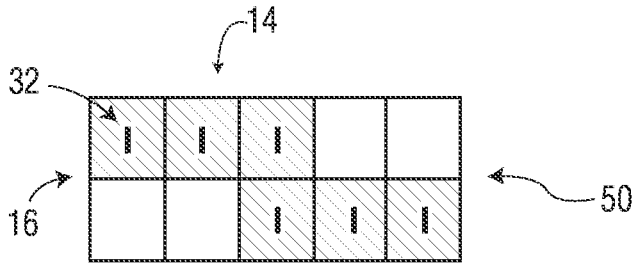
Figure 12B:
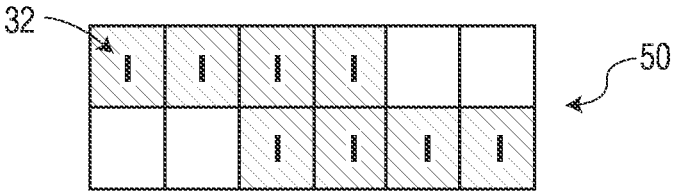
Figure 12C:
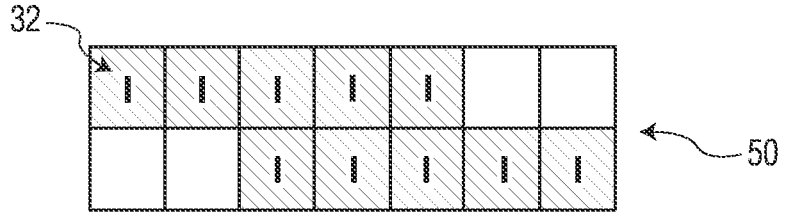
Figure 12D:
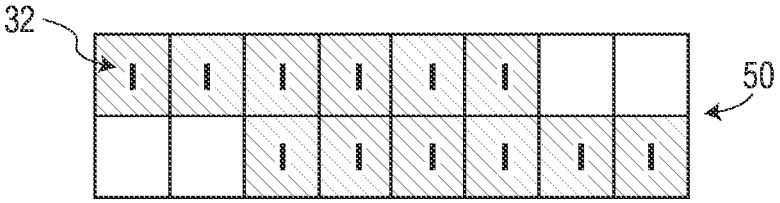
Figure 12E:
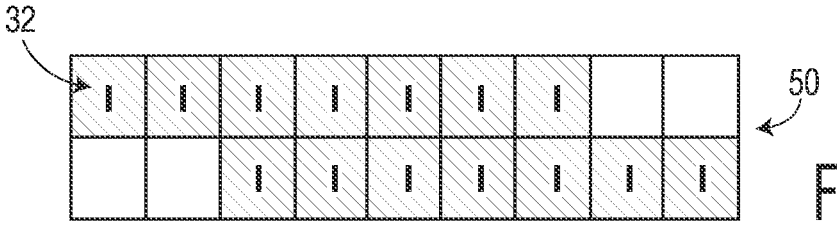
Figure 13A:
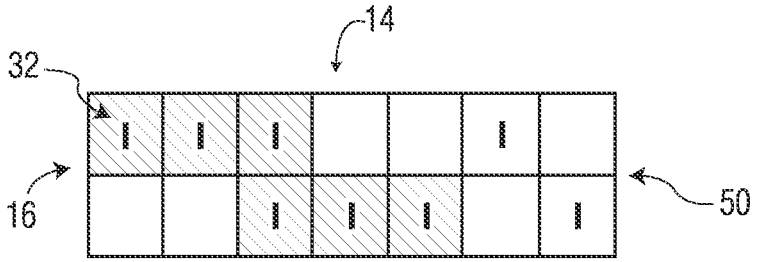
Figure 13B:
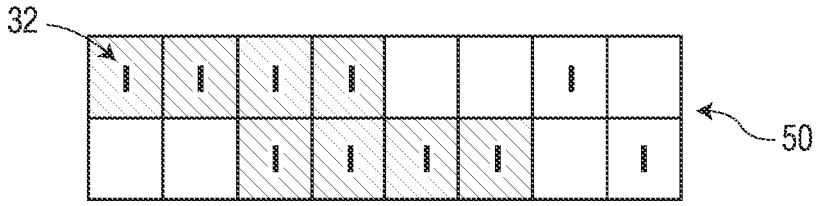
Figure 13C:
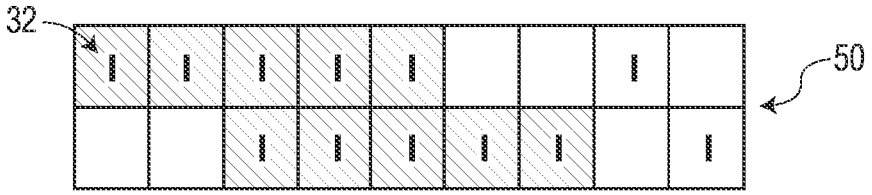
Figure 13D:
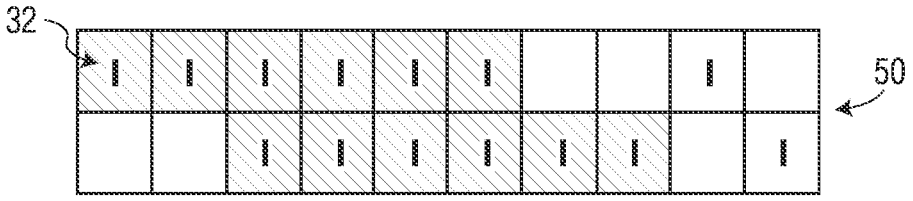
Figure 13E:
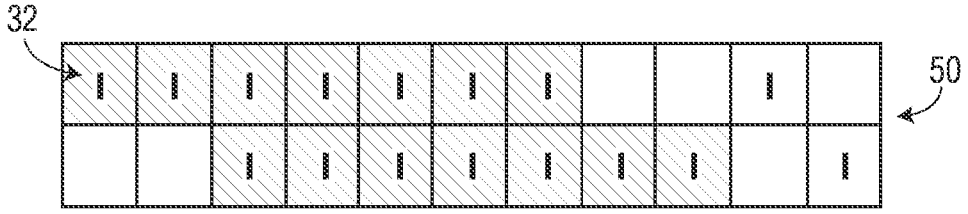
Figure 14A:
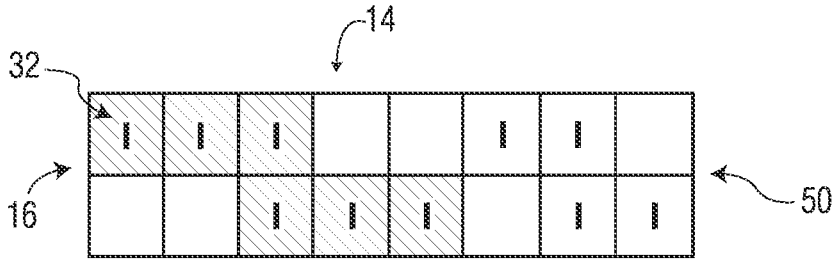
Figure 14B:
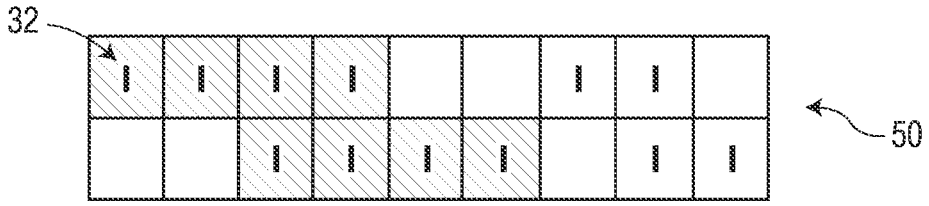
Figure 14C:
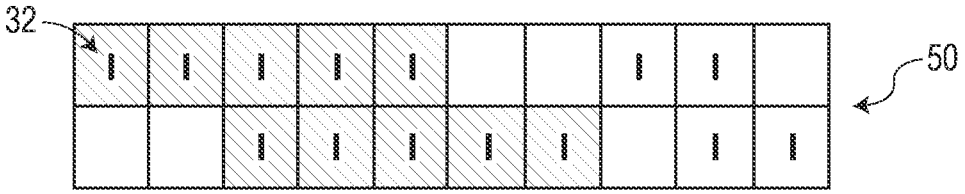
Figure 14D:
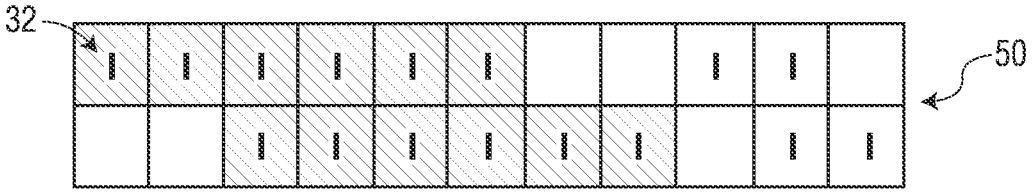
Figure 14E:
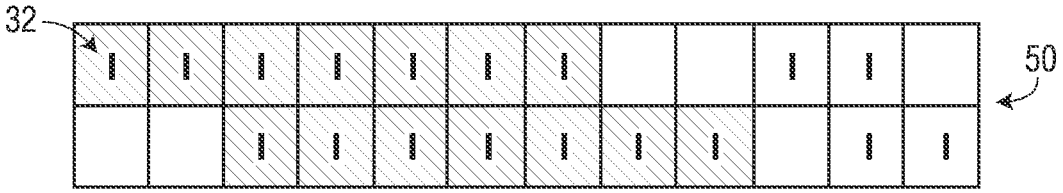
Figure 15A:
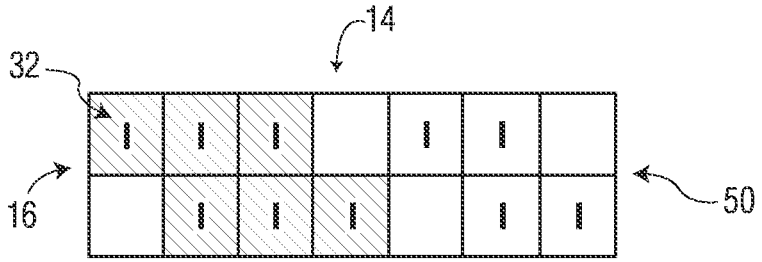
Figure 15B:
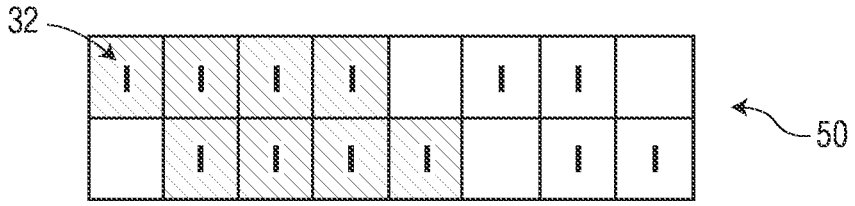
Figure 15C:
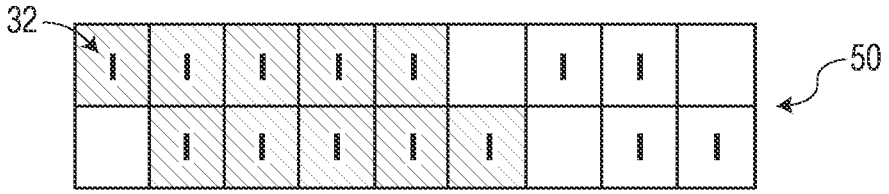
Figure 15D:
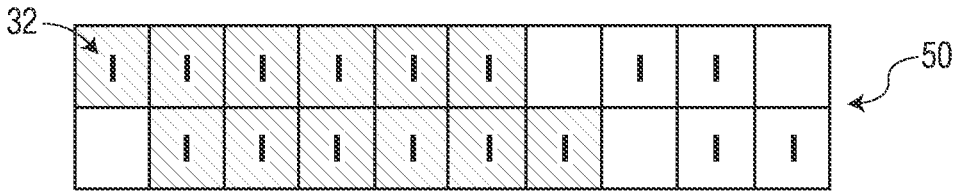
Figure 15E:
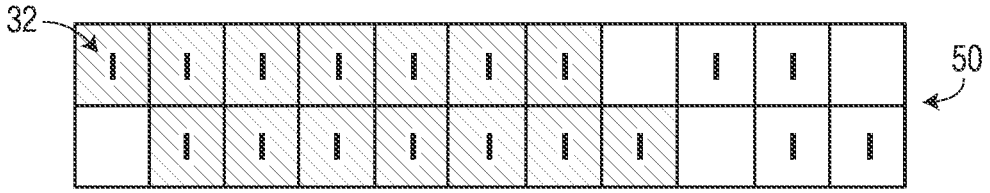
Figure 16A:
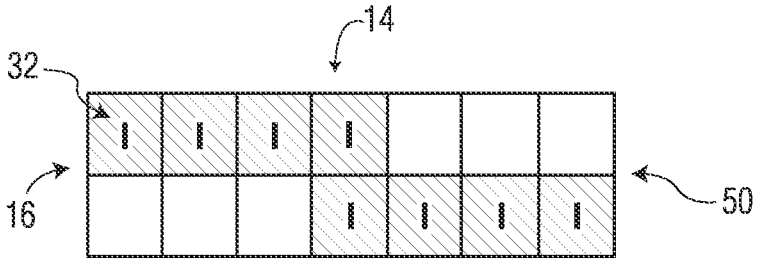
Figure 16B:
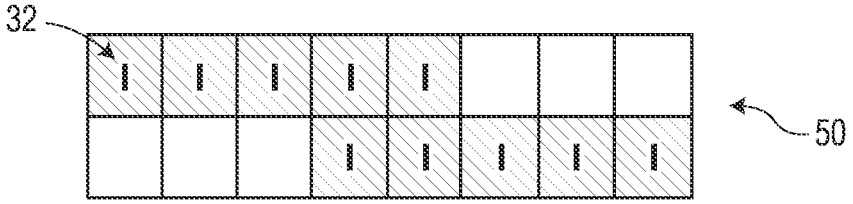
Figure 16C:
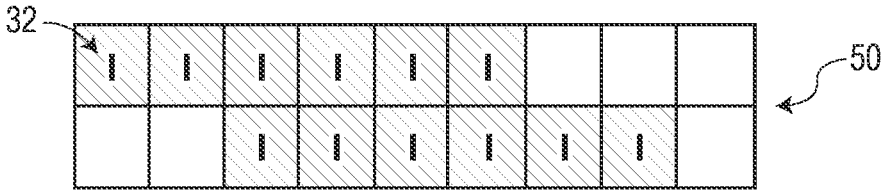
Figure 16D:
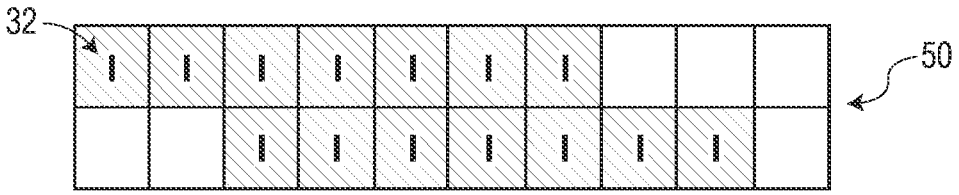
Figure 17A:
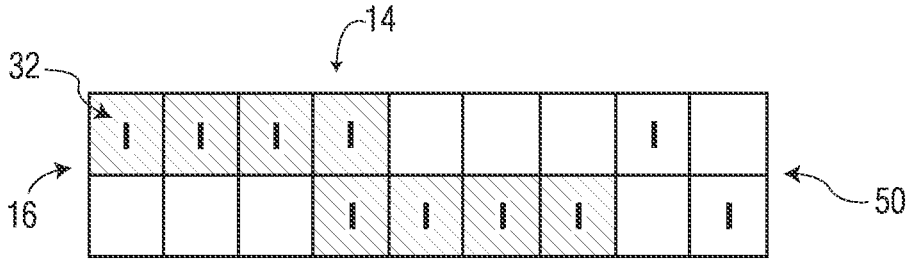
Figure 17B:
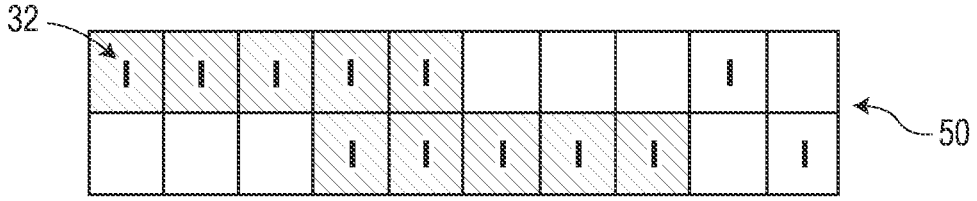
Figure 17C:
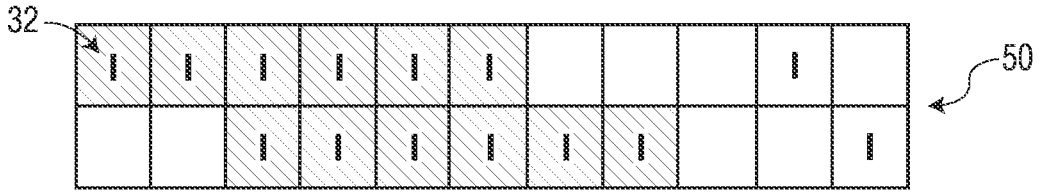
Figure 17D:
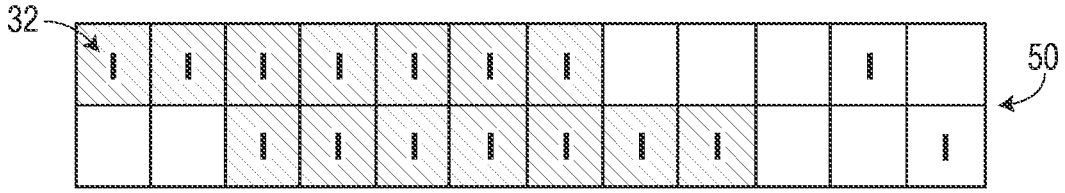
Figure 18A:
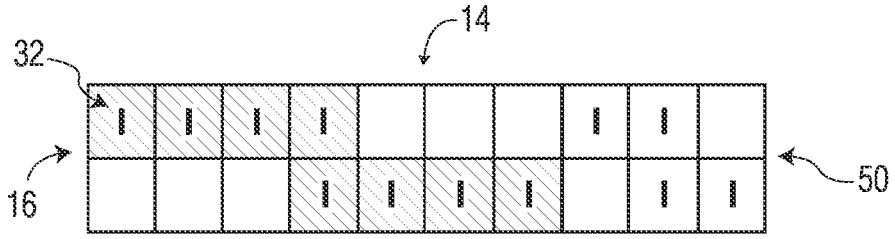
Figure 18B:
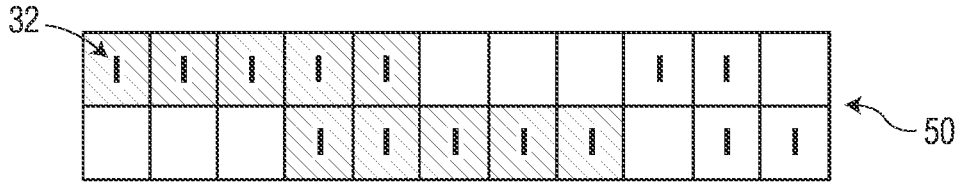
Figure 18C:
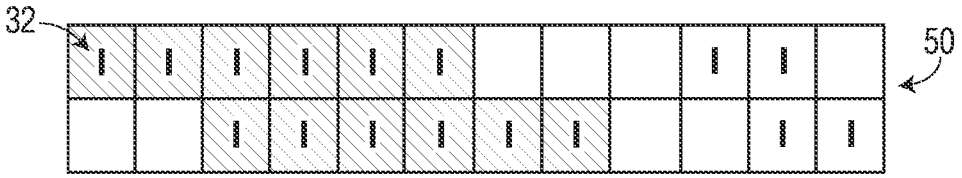
Figure 18D:
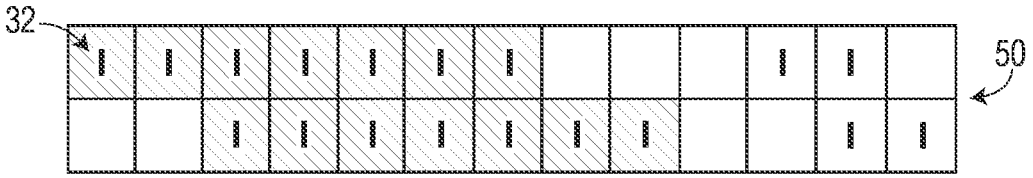

Another benefit to the offset shute float weave pattern 36 is that various base structures 50 can be developed that are known to be stable according to the principles discussed above and then the various base structures 50 can be combined in a modular fashion to form a weave pattern having one or more protuberances 22 with the knowledge that the weave pattern will be stable as long as the offset shute float weave pattern 36 is maintained for each protuberance forming area 32 that is created by combining the base structures 50. FIGS. 8A-18D provide examples of various base structures 50 that provide a design element by the depicted protuberance forming area 32. The base structures 50 for FIGS. 8A-18D are each comprised of two shute filaments 16, however, the size of the base structures 50 in terms of the number of shute filaments 16 can be modified to be greater than two shute filaments 16. The base structures 50 can be of various amounts of warp filaments 14, such as, for example, four warp filaments 14 as depicted in FIG. 8A or can include more warp filaments 14 such as thirteen warp filaments 14 as depicted in FIG. 18D. It is contemplated that base structures 50 can be developed to have more than thirteen warp filaments 14 as well, such as fifteen warp filaments 14, or twenty warp filaments 14, or more.

Thus, one method of manufacturing a woven papermaking fabric 10 can include providing a first set of filaments to serve as warp filaments 14 in a loom and providing a second set of filaments to serve as shute filaments 16 in the loom. The method can also include providing a plurality of weave patterns. The weave patterns can correspond to a unique design element, as shown in FIGS. 8A-18D. The method can then include selecting the first weave pattern corresponding to the first design element and selecting the second weave pattern corresponding to the second design element. Then the method can involve weaving the shute filaments 16 with the warp filaments 14 in a lateral direction to provide a web contacting side 20 of the woven papermaking fabric 10 and a machine contacting side 18 of the woven papermaking fabric 10 and following the first weave pattern to provide a first protuberance 22 on the web contacting side 20 of the woven papermaking fabric 10 providing the first design element and following the second weave pattern to provide a second protuberance 22 on the web contacting side 20 of the woven papermaking fabric 10 to provide the second design element. As described above with respect to the weave patterns 30, 130, 230, 330 of FIGS. 3A1-3A3, 5A, 6A, and 7A, respectively, the method can include stabilizing the protuberances 22 by weaving the shute filaments 16 forming the first protuberance 22 and weaving the shute filaments 16 forming the second protuberance 22 to each have an offset shute float weave pattern 36. As noted above, the offset shute float pattern 36 can be configured such that a majority of the shute filaments 16 forming the first protuberance 22 and a majority of the shute filaments 16 forming the second protuberance 22 are woven in an anti-nesting configuration to provide stability to the first protuberance 22 and the second protuberance 22.

EMBODIMENTS

Embodiment 1

A woven papermaking fabric comprising: a plurality of filaments woven together, the plurality of filaments comprising: a plurality of warp filaments extending in a longitudinal direction; and a plurality of shute filaments extending in a lateral direction, the shute filaments being interwoven with warp filaments to provide a web contacting side of the woven papermaking fabric and a machine contacting side of the woven papermaking fabric; and at least one protuberance on the web contacting side of the woven papermaking fabric, the at least one protuberance extending longitudinally over at least five shute filaments, each shute filament forming part of the at least one protuberance including: a float proximal end; and a float distal end; wherein the at least one protuberance is stabilized by including an offset shute float weave pattern configured such that a majority of the shute filaments forming the at least one protuberance are woven in an anti-nesting configuration.

Embodiment 2

The woven papermaking fabric of embodiment 1, wherein the offset shute float weave pattern is configured such that substantially all of the shute filaments forming the at least one protuberance are woven in the anti-nesting configuration.

Embodiment 3

The woven papermaking fabric of embodiment 1 or embodiment 2, further comprising a plurality of protuberances on the web contacting side of the fabric.

Embodiment 4

The woven papermaking fabric of embodiment 3, wherein the plurality of protuberances each extend longitudinally over at least seven shute filaments and each are stabilized by including the offset shute float weave pattern.

Embodiment 5

The woven papermaking fabric of embodiment 3 or embodiment 4, wherein the plurality of protuberances are each configured to be of the same design.

Embodiment 6

The woven papermaking fabric of embodiment 3 or embodiment 4, wherein the plurality of protuberances include at least two different designs.

Embodiment 7

The woven papermaking fabric of embodiment 1 or embodiment 2, wherein the at least one protuberance extends substantially the full length of the fabric.

Embodiment 8

A method of manufacturing a woven papermaking fabric, the method comprising: providing a first set of filaments to serve as warp filaments in a loom, the warp filaments extending in a longitudinal direction; providing a second set of filaments to serve as shute filaments; weaving the shute filaments with the warp filaments in a lateral direction to provide a web contacting side of the woven papermaking fabric and a machine contacting side of the woven papermaking fabric and to provide at least one protuberance on the web contacting side of the woven papermaking fabric, the at least one protuberance extending longitudinally over at least five shute filaments, each of the shute filaments forming the at least one protuberance including a float proximal end and a float distal end; and stabilizing the at least one protuberance on the web contacting side of the fabric by weaving the shute filaments forming the at least one protuberance in an offset shute float weave pattern, the offset shute float weave being configured such that a majority of the shute filaments forming the at least one protuberance are woven in an anti-nesting configuration.

Embodiment 9

The method of embodiment 8, wherein the offset shute float weave pattern is configured such that substantially all of the shute filaments forming the at least one protuberance are woven in an anti-nesting configuration.

Embodiment 10

The method of embodiment 8 or embodiment 9, further comprising: connecting a first longitudinal end of the woven papermaking fabric to a second longitudinal end of the woven papermaking fabric to provide a seam for the woven papermaking fabric.

Embodiment 11

The method of any one of embodiments 8 through 10, further comprising:

weaving the shute filaments with the warp filaments to provide a plurality of protuberances on the web contacting side of the fabric.

Embodiment 12

The method of embodiment 11, wherein the plurality of protuberances are each configured to be of the same design.

Embodiment 13

The method of embodiment 11, wherein the plurality of protuberances include at least two different designs.

Embodiment 14

The method of any one of embodiments 8 through 10, wherein the at least one protuberance extends substantially the full length of the fabric.

Embodiment 15

A method of manufacturing a woven papermaking fabric, the method comprising: providing a first set of filaments to serve as warp filaments in a loom, the warp filaments extending in a longitudinal direction; providing a second set of filaments to serve as shute filaments in the loom; providing a plurality of weave patterns corresponding to design elements for the woven fabric, the plurality of weave patterns comprising: a first weave pattern corresponding to a first design element; and a second weave pattern corresponding to a second design element, wherein the first design element is different from the second design element; selecting the first weave pattern corresponding to the first design element; selecting the second weave pattern corresponding to the second design element; and weaving the shute filaments with the warp filaments in a lateral direction to provide a web contacting side of the woven papermaking fabric and a machine contacting side of the woven papermaking fabric, following the first weave pattern to provide a first protuberance on the web contacting side of the woven papermaking fabric providing the first design element, and following the second weave pattern to provide a second protuberance on the web contacting side of the woven papermaking fabric providing the second design element; wherein each of the shute filaments forming the first protuberance and each of the shute filaments forming the second protuberance each comprise a float proximal end and a float distal end; and wherein the first protuberance and the second protuberance are stabilized by weaving the shute filaments forming the first protuberance and weaving the shute filaments forming the second protuberance to each have an offset shute float weave pattern, the offset shute float weave pattern being configured such that a majority of the shute filaments forming the first protuberance and a majority of the shute filaments forming the second protuberance are woven in an anti-nesting configuration.

Embodiment 16

The method of embodiment 15, wherein the offset shute float weave pattern is configured such that substantially all of the shute filaments forming the first protuberance and substantially all of the shute filaments forming the second protuberance are woven in the anti-nesting configuration.

Embodiment 17

The method of embodiment 15 or embodiment 16, wherein the first protuberance and the second protuberance provide a converging pattern.

Embodiment 18

The method of any one of embodiments 15 through 17, wherein the plurality of weave patterns further comprises a third weave pattern corresponding to a third design element, and wherein weaving the shute filaments with the warp filaments in the lateral direction to provide the web contacting side of the fabric and the machine contacting side of the fabric further comprises following the third weave pattern to provide a third protuberance providing the third design element, and wherein each of the shute filaments forming the third protuberance comprises a float proximal end and a float distal end, and wherein the third protuberance is stabilized by weaving the shute filaments forming the third protuberance to have a third offset shute float weave pattern, the third offset shute float weave pattern being configured such that a majority of the shute filaments forming the third protuberance are woven in an anti-nesting configuration.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present disclosure should be assessed as that of the appended claims and any equivalents thereto.

What is claimed is:

1. A method of manufacturing a woven papermaking fabric, the method comprising:

providing a first set of filaments to serve as warp filaments in a loom, the warp filaments extending in a longitudinal direction;

providing a second set of filaments to serve as shute filaments;

weaving the shute filaments with the warp filaments in a lateral direction to provide a web contacting side of the woven papermaking fabric and a machine contacting side of the woven papermaking fabric and to provide at least one protuberance on the web contacting side of the woven papermaking fabric, the at least one protuberance extending longitudinally over at least five shute filaments and having a height from about 0.2 to about 3.0 mm, each of the shute filaments forming the at least one protuberance including a float proximal end and a float distal end; and stabilizing the at least one protuberance on the web contacting side of the fabric by weaving the shute filaments forming the at least one protuberance in an offset shute float weave pattern, the offset shute float weave being configured such that a majority of the shute filaments forming the at least one protuberance are woven in an anti-nesting configuration.

2. The method of claim 1, wherein the offset shute float weave pattern is configured such that substantially all of the shute filaments forming the at least one protuberance are woven in an anti-nesting configuration.

3. The method of claim 1, further comprising:

connecting a first longitudinal end of the woven papermaking fabric to a second longitudinal end of the woven papermaking fabric to provide a seam for the woven papermaking fabric.

4. The method of claim 1, further comprising:

weaving the shute filaments with the warp filaments to provide a plurality of protuberances on the web contacting side of the fabric.

5. The method of claim 4, wherein the plurality of protuberances are each configured to be of the same design.

6. The method of claim 4, wherein the plurality of protuberances include at least two different designs.

7. The method of claim 4, wherein the at least one protuberance extends substantially the full length of the fabric.

8. A method of manufacturing a woven papermaking fabric, the method comprising:

providing a first set of filaments to serve as warp filaments in a loom, the warp filaments extending in a longitudinal direction;

providing a second set of filaments to serve as shute filaments in the loom;

providing a plurality of weave patterns corresponding to design elements for the woven fabric, the plurality of weave patterns comprising:

a first weave pattern corresponding to a first design element; and a second weave pattern corresponding to a second design element, wherein the first design element is different from the second design element;

selecting the first weave pattern corresponding to the first design element;

selecting the second weave pattern corresponding to the second design element; and weaving the shute filaments with the warp filaments in a lateral direction to provide a web contacting side of the woven papermaking fabric and a machine contacting side of the woven papermaking fabric, following the first weave pattern to provide a first protuberance on the web contacting side of the woven papermaking fabric providing the first design element, and following the second weave pattern to provide a second protuberance on the web contacting side of the woven papermaking fabric providing the second design element;

wherein each of the shute filaments forming the first protuberance and each of the shute filaments forming the second protuberance each comprise a float proximal end and a float distal end;

and wherein the first protuberance and the second protuberance have a height from about 0.2 to about 3.0 mm and are stabilized by weaving the shute filaments forming the first protuberance and weaving the shute filaments forming the second protuberance to each have an offset shute float weave pattern, the offset shute float weave pattern being configured such that a majority of the shute filaments forming the first protuberance and a majority of the shute filaments forming the second protuberance are woven in an anti-nesting configuration.

9. The method of claim 8, wherein the offset shute float weave pattern is configured such that substantially all of the shute filaments forming the first protuberance and substantially all of the shute filaments forming the second protuberance are woven in the anti-nesting configuration.

10. The method of claim 8, wherein the first protuberance and the second protuberance provide a converging pattern.

11. The method of claim 8, wherein the plurality of weave patterns further comprises a third weave pattern corresponding to a third design element, and wherein weaving the shute filaments with the warp filaments in the lateral direction to provide the web contacting side of the fabric and the machine contacting side of the fabric further comprises following the third weave pattern to provide a third protuberance providing the third design element, and wherein each of the shute filaments forming the third protuberance comprises a float proximal end and a float distal end, and wherein the third protuberance is stabilized by weaving the shute filaments forming the third protuberance to have a third offset shute float weave pattern, the third offset shute float weave pattern being configured such that a majority of the shute filaments forming the third protuberance are woven in an anti-nesting configuration.

* * * * *